US010492552B2

(12) United States Patent
Jaeger et al.

(10) Patent No.: US 10,492,552 B2
(45) Date of Patent: Dec. 3, 2019

(54) HYDRATION AND AUDIO SYSTEM

(71) Applicant: RainMaker Solutions, Inc., El Segundo, CA (US)

(72) Inventors: Eduard Albert Jaeger, El Segundo, CA (US); Robert Gregory Stahl, Culver City, CA (US); Jacob Timm Bowles, El Segundo, CA (US)

(73) Assignee: RainMaker Solutions, Inc., El Segundo, CA (US)

( * ) Notice: Subject to any disclaimer, the term of this patent is extended or adjusted under 35 U.S.C. 154(b) by 0 days.

(21) Appl. No.: 15/817,031

(22) Filed: Nov. 17, 2017

(65) Prior Publication Data

US 2018/0192724 A1 Jul. 12, 2018

Related U.S. Application Data

(60) Provisional application No. 62/423,415, filed on Nov. 17, 2016.

(51) Int. Cl.

| | |
|---|---|
| ***A42B 3/04*** | (2006.01) |
| ***A42B 3/30*** | (2006.01) |
| ***H04R 1/08*** | (2006.01) |
| ***A42B 1/24*** | (2006.01) |
| ***H04R 1/04*** | (2006.01) |

(Continued)

(52) U.S. Cl.

CPC ..... *A42B 1/24* (2013.01); *A42B 3/048* (2013.01); *A42B 3/30* (2013.01); *H04R 1/04* (2013.01); *H04R 1/083* (2013.01); *A62B 7/12* (2013.01); *A62B 18/086* (2013.01)

(58) Field of Classification Search

CPC ..... A42B 1/24; A42B 3/048; A42B 18/086; A42B 3/28; A42B 3/286; A42B 3/283; A42B 3/00; A42B 3/0406; A42B 3/30; A42B 3/303; A42B 3/306; F16L 37/004; F16L 2201/80; A62B 18/04; A62B 18/045; A62B 18/08; H04R 1/04; H04R 1/08; H04R 1/083

USPC ..... 224/181, 183, 148.2; 285/9.1

See application file for complete search history.

(56) References Cited

U.S. PATENT DOCUMENTS 2,793,057 A * 5/1957 McGugin ..... F16L 37/00 285/114

2,879,343 A 3/1959 Finken (Continued)

FOREIGN PATENT DOCUMENTS

AU 2006100999 A4 1/2007

EP 1092362 A2 4/2001

(Continued)

OTHER PUBLICATIONS

Apr. 25, 2018, International Search Report and Written Opinion issued in related PCT Application No. PCT/US2017/062348 filed Nov. 17, 2017.

*Primary Examiner* — Justin M Larson

(74) *Attorney, Agent, or Firm* — Brooks Kushman P.C.

(57) ABSTRACT

A combined microphone and fluid-delivery apparatus includes a microphone disposed at an end of a support member, and a fluid passageway supported by the support member. A mouthpiece extends from the passageway so as to be positioned adjacent the microphone. The mouthpiece defines an outlet port that is in fluid communication with the fluid passageway.

35 Claims, 18 Drawing Sheets

(51) Int. Cl.
*A62B 7/12* (2006.01)
*A62B 18/08* (2006.01)

(56) References Cited

U.S. PATENT DOCUMENTS 3,181,895 A * 5/1965 Cator ..... F16L 37/004 285/1
3,645,261 A 2/1972 West
3,731,717 A 5/1973 Potash
4,304,415 A 12/1981 Wolf et al.
4,406,385 A 9/1983 Pribyl
4,491,088 A 1/1985 Hostetler
4,549,541 A 10/1985 Sundahl
4,591,192 A 5/1986 Van Exel et al.
4,629,098 A 12/1986 Eger
4,633,816 A 1/1987 Ove et al.
4,681,244 A 7/1987 Geddie
4,815,635 A 3/1989 Porter
5,039,035 A 8/1991 Fitzpatrick
5,060,833 A * 10/1991 Edison ..... A45F 3/16 215/388
5,062,591 A 11/1991 Runkel
5,085,349 A * 2/1992 Fawcett ..... A45F 3/20 220/703
5,201,442 A 4/1993 Bakalian
5,277,581 A 1/1994 Peterson
5,322,245 A 6/1994 Bassick
5,571,260 A * 11/1996 Krug ..... A45F 3/16 222/175
5,603,361 A 2/1997 Cuisinier
5,607,087 A 3/1997 Wery et al.
5,645,404 A 7/1997 Zelenak
5,727,714 A * 3/1998 Fawcett ..... A45F 3/16 222/175
5,755,368 A 5/1998 Bekkedahl
5,803,333 A 9/1998 Fawcett
5,816,457 A 10/1998 Croft
5,913,456 A 6/1999 Dikeman
5,975,387 A 11/1999 Gleason
5,984,145 A * 11/1999 McAllister ..... A45F 3/16 222/175
6,039,305 A 3/2000 Hoskins
6,070,767 A * 6/2000 Gardner ..... A45F 3/16 220/703
6,145,695 A 11/2000 Garrigues
6,212,959 B1 4/2001 Perkins
6,283,344 B1 * 9/2001 Bradley ..... A42B 1/24 222/175
6,409,048 B1 6/2002 Belzeski
6,422,439 B1 7/2002 Kelliher
6,497,348 B2 12/2002 Forsman
6,644,854 B2 11/2003 Lien
6,666,360 B1 12/2003 Swank
6,758,213 B1 7/2004 Brekken
6,820,780 B2 11/2004 Forsman
6,837,026 B2 1/2005 Setton
6,886,807 B1 5/2005 Gill
6,892,915 B2 5/2005 Mares
6,990,860 B1 1/2006 Gillanders
6,997,181 B2 * 2/2006 Fletcher ..... A62B 18/086 128/201.28
7,007,826 B2 3/2006 Shapanus et al.
7,073,688 B2 * 7/2006 Choi ..... A45F 3/20 141/379
7,130,439 B2 * 10/2006 Chen ..... A62B 23/02 381/376
7,131,170 B2 11/2006 Weaver
7,175,059 B2 2/2007 Copich
7,201,299 B2 4/2007 Forsman
7,252,112 B1 * 8/2007 Imler ..... F16L 37/004 137/614.04
7,311,231 B2 12/2007 Noell
7,464,837 B2 12/2008 Hoskins
7,490,740 B2 * 2/2009 Robins ..... A45F 3/20 222/175
7,509,692 B2 3/2009 Elkins
7,533,786 B2 5/2009 Woolfson
7,600,656 B2 10/2009 Karl
7,665,156 B1 2/2010 Hewitt
7,762,432 B2 7/2010 Fidrych
7,793,987 B1 * 9/2010 Busch ..... A61M 16/0816 285/9.1
7,806,300 B1 10/2010 Noell
7,820,946 B2 10/2010 Woodfill
7,891,637 B2 2/2011 Zimmermann et al.
8,001,623 B2 8/2011 Gertsch
8,047,411 B2 11/2011 Thatcher
8,083,105 B2 12/2011 Reichert
8,136,702 B2 3/2012 Skillern
8,167,177 B1 5/2012 Galgano
8,177,097 B2 5/2012 Duran
8,220,664 B1 7/2012 Teetzel
8,276,785 B1 10/2012 Wheatley
8,378,830 B2 2/2013 Moran
8,453,893 B2 6/2013 Shitaye
8,544,688 B2 10/2013 Ballentine
8,604,392 B1 12/2013 Ostrom
8,622,262 B2 1/2014 Van Art
8,640,693 B2 2/2014 Low
8,715,305 B2 5/2014 Pate et al.
8,887,962 B2 11/2014 Herivel
8,973,173 B2 3/2015 Elam et al.
9,125,479 B2 9/2015 Chapuis
9,140,393 B2 * 9/2015 Wolff ..... F16L 37/004
9,179,719 B1 11/2015 Goldberg
9,322,498 B2 * 4/2016 Wolff ..... F16L 37/004
9,375,742 B1 6/2016 Yoked
9,402,119 B2 * 7/2016 Contreras Hernandez ..... A62B 18/08
9,440,248 B2 * 9/2016 Pouliaude ..... B05B 11/0008
9,506,590 B2 11/2016 Wilhelm et al.
9,624,083 B2 4/2017 Tuggle et al.
9,657,727 B2 5/2017 Osborn
9,803,787 B2 * 10/2017 Scott ..... F16L 37/004
9,828,982 B1 11/2017 Richardson
10,016,569 B2 * 7/2018 Flower ..... A61M 16/021
10,179,726 B2 * 1/2019 Steele ..... A62B 18/086
2002/0092858 A1 7/2002 Bowman
2002/0113101 A1 8/2002 Skillern
2002/0124294 A1 9/2002 McKenzie
2002/0179647 A1 12/2002 Hall
2003/0075573 A1 4/2003 Bailey
2003/0154983 A1 8/2003 Marx
2004/0000570 A1 1/2004 Forsman
2004/0045980 A1 3/2004 Robins
2004/0065703 A1 4/2004 Bellucci
2004/0103684 A1 6/2004 Kreutzmann
2004/0235429 A1 11/2004 Garavaglia et al.
2005/0051235 A1 3/2005 Kline
2005/0061831 A1 3/2005 Brown
2005/0062009 A1 3/2005 Hoskins
2005/0238193 A1 * 10/2005 Chen ..... A62B 23/02 381/376
2005/0241641 A1 * 11/2005 Fletcher ..... A62B 18/086 128/205.22
2006/0000856 A1 1/2006 West
2006/0038028 A1 2/2006 Miller
2006/0071006 A1 4/2006 Lojkutz
2006/0113336 A1 6/2006 Spencer
2006/0151534 A1 7/2006 Mares
2006/0180154 A1 * 8/2006 Stone ..... A42B 3/048 128/207.11
2006/0231561 A1 10/2006 Choi et al.
2006/0243765 A1 11/2006 Valeriana
2006/0255048 A1 11/2006 Bemis
2007/0012733 A1 1/2007 Horito
2007/0028359 A1 2/2007 Robinson
2007/0075094 A1 4/2007 Brown
2007/0090135 A1 4/2007 Benham
2007/0095867 A1 5/2007 Tomlin
2007/0108238 A1 5/2007 Kirker
2007/0181616 A9 8/2007 Horito et al.
2007/0262109 A1 11/2007 Withrow
2008/0067202 A1 3/2008 Silva

(56) References Cited

U.S. PATENT DOCUMENTS

2008/0143098 A1* 6/2008 Zimmermann ..... F16L 37/004 285/9.1
2008/0179356 A1 7/2008 Edy
2008/0217367 A1 9/2008 Lillie
2008/0277433 A1 11/2008 Karl
2008/0296317 A1 12/2008 Baker
2009/0095773 A1 4/2009 Pinne
2009/0146412 A1* 6/2009 Schoenoff ..... F16L 37/004 285/9.1
2009/0179046 A1 7/2009 Reichert
2009/0242587 A1 10/2009 Bemis
2010/0044396 A1 2/2010 Skillern
2010/0123019 A1 5/2010 Zehavi
2010/0264175 A1 10/2010 Fidrych
2010/0282795 A1 11/2010 Wrigley et al.
2010/0307497 A1 12/2010 Busch et al.
2010/0307715 A1 12/2010 Emenheiser
2010/0314415 A1 12/2010 Carter
2010/0322826 A1* 12/2010 Locascio ..... B01J 19/0093 422/537
2011/0006084 A1 1/2011 Staton
2011/0084474 A1* 4/2011 Paden ..... F16L 37/004 285/9.1
2011/0113524 A1 5/2011 Sinder
2011/0131713 A1 6/2011 DaRosa
2012/0013117 A1* 1/2012 Bernshtein ..... F16L 37/004 285/9.1
2012/0111876 A1 5/2012 Pfotenhauer
2012/0186656 A1 7/2012 Fitzgerald
2012/0193382 A1 8/2012 Wilson
2012/0246809 A1* 10/2012 Elam ..... A42B 3/048 2/424
2013/0056372 A1 3/2013 Lynch
2013/0200104 A1 8/2013 Whitehead
2013/0292407 A1 11/2013 Beavis et al.
2014/0076941 A1 3/2014 Sprague
2014/0252043 A1 9/2014 Pouliaude
2014/0311239 A1 10/2014 Marjanovic
2014/0318650 A1* 10/2014 Wolff ..... F16L 37/004 137/614.02
2015/0014439 A1 1/2015 Carrozza
2015/0076815 A1 3/2015 Lombardi, III et al.
2015/0083762 A1 3/2015 Radosta
2015/0250972 A1 9/2015 Haibach et al.
2016/0090981 A1 3/2016 Ryan
2016/0094911 A1 3/2016 Kropf
2016/0104373 A1 4/2016 Geerlings
2016/0296825 A1 10/2016 Wolniansky et al.
2017/0022042 A1 1/2017 Lux et al.
2018/0035787 A1* 2/2018 Jaeger ..... A42B 3/0406
2018/0192724 A1* 7/2018 Jaeger ..... A42B 1/24
2018/0193676 A1* 7/2018 Jaeger ..... A42B 3/285
2018/0195654 A1* 7/2018 Jaeger ..... A42B 3/285

FOREIGN PATENT DOCUMENTS

WO WO2004033360 A3 5/2004
WO WO2005007066 A2 1/2005
WO WO2006020593 A1 2/2006
WO WO2009007969 A2 1/2009
WO WO2009023849 A1 2/2009
WO WO2009077681 A2 6/2009
WO WO2009/158413 A2 12/2009
WO WO2010038015 A1 4/2010
WO WO2010077196 A1 7/2010
WO WO2011003110 A2 1/2011
WO WO2011028839 A2 3/2011
WO WO2011017295 A3 6/2011
WO WO2013038179 A1 3/2013
WO WO2018/007966 A1 1/2018
WO WO2018/017545 A1 1/2018

* cited by examiner

HYDRATION AND AUDIO SYSTEM

CROSS-REFERENCE TO RELATED APPLICATIONS

This application claims the benefit of U.S. Provisional Application No. 62/423,415, filed Nov. 17, 2016, which is hereby incorporated by reference.

This application is also related to U.S. Provisional Application No. 62/363,334, filed Jul. 18, 2016, which is incorporated herein by reference as if fully set forth herein.

This application is also related to the Application entitled HYDRATION AND AIR COOLING SYSTEM that was filed on Nov. 17, 2016, and assigned U.S. Provisional Application No. 62/423,430, the disclosure of which is incorporated herein by reference as if fully set forth herein.

This application is also related the Application entitled HYDRATION SYSTEMS AND COMPONENTS THEREOF that was filed on Nov. 17, 2016, and assigned U.S. Provisional Application No. 62/423,756, the disclosure of which is incorporated herein by reference as if fully set forth herein.

TECHNICAL FIELD

This disclosure relates to a combined fluid and audio delivery system and more specifically to a fluid and audio delivery system having a mouthpiece assembly having audio and fluid-delivery capabilities.

BACKGROUND

Medical research has demonstrated the importance of maintaining adequate hydration to maintain a person's physical and mental health. Serious consequences can occur due to the lack of proper hydration. These consequences can range in severity from fatigue and nausea to loss of consciousness and even death. To maintain optimum health, physicians generally recommend that under normal conditions individuals drink at least eight 8-ounce (240 ml) glasses of water a day (for a total of a gallon of water per day). When an individual is under physical exertion, exposed to extreme environmental conditions, and/or over weight, the amount of fluids that the individual needs to consume generally increases because the individual's rate of fluid loss increases under such circumstances. Thus, regardless of whether a person is exercising, working, or simply resting, maintaining proper hydration and peak performance (both physical and mental) requires the regular ingestion of fluids, which in turn requires the availability of fluids to ingest.

Various portable devices have been developed to help address the availability problem. These devices have included, for example, aluminum canteens and plastic water bottles. While these devices are reasonably light, durable, and inexpensive, they do not allow hands-free fluid consumption, which may be desirable or even extremely important in some applications. In addition, they are often awkwardly mounted to a waist belt or in a pocket of a backpack, making the process of accessing them during certain activities impractical and even unsafe. As a result, individuals using these types of portable devices often go without fluids longer than they should. Frequently, this is because the user has to wait for a suitable break in their activity before safely reaching for the water bottle or canteen. Because of the inconvenience and/or safety issues, individuals using these types of devices also often wait until they feel thirsty before finding a suitable break in whatever activity they are engaged to have a drink. The problem with this approach, however, is that by the time a person is thirsty, they are already dehydrated and thus their body is no longer capable of optimal performance. In addition, if an individual waits too long to properly hydrate, their body can begin to cramp, causing pain and a further reduction in the individual's ability to engage in physical activity. Moreover, a person does not immediately recover from dehydration by drinking water. This is because the cells of the human body begin to shut down once the human body becomes dehydrated, and it is only through a slow process of re-hydration that the cells of the body can recover and begin to function properly again.

More recently, personal hydration systems have been developed that offer a number of advantages over water bottles and canteens, including improved fluid delivery capabilities and convenience. These systems frequently include either a semi-rigid or flexible bag-like fluid reservoir that may be carried in a pack on the user's back or waist. These systems permit a user to drink more frequently while engaged in a variety of sporting, recreational, and work-related activities because a long flexible drink tube is connected to the reservoir through an exit port at one end and terminates in a mouthpiece with a bite valve at the other end. The tube is long enough to allow the mouthpiece to be carried in the user's mouth to enable the user to draw water from the reservoir at will. Examples of personal hydration systems of this type and mouthpieces therefor are disclosed in U.S. Pat. Nos. 5,727,714, 5,060,833, 5,085,349, 6,070,767, and 7,490,740.

Another shortcoming in these conventional systems is that the drink tube is left dangling. As a result, when the user releases the mouthpiece located on the terminal end of the of the drink tube from the user's mouth, the tube will fall away from the user's mouth and require the user to retrieve the drink tube and put the mouthpiece back in his or her mouth the next time another drink is desired. It may not be practical (or even safe) for a user to manipulate the drink tube in this manner during certain activities, for example, when the user is traveling at a high rate of speed, such as on bicycle, in a race car, or on a motorcycle. Yet, it is also not always practical, or even desirable, for the user to keep the mouthpiece in his or her mouth at all times.

Headgear has been developed to facilitate hands-free hydration. The headgear is designed to permit the bite-valve of the drink tube to be adjustably located in front of the user's mouth. This type of headgear is described in U.S. Pat. No. 6,283,344 to Bradley.

SUMMARY

According to one embodiment, a combined microphone and fluid-delivery apparatus includes a housing defining an inner chamber and a microphone disposed within the inner chamber. A fluid passageway is supported by the housing. A mouthpiece extends from the housing and defines an outlet port in fluid communication with the fluid passageway.

According to another embodiment, a headset includes a headgear and a flexible support member having a microphone disposed at one end of the support member and being supported by the headgear at the other end of the support member. A microphone case is supported by the flexible support member and has a microphone-receiving area in which the microphone is received. A fluid passageway is attached to the microphone case. A mouthpiece is disposed at the distal end of the fluid passageway and is adjacent the microphone. The mouthpiece includes an outlet port that is in fluid communication with the passageway and that is pointed in a direction away from the microphone.

According to yet another embodiment, a headset includes a microphone casing defining a microphone-receiving area and a fluid-delivery enclosure that are separated by an internal wall of the microphone casing. The fluid-delivery enclosure has an outlet on an exterior surface of the casing and an inlet. A microphone is disposed in the microphone-receiving area, and a valve interposed between the inlet and outlet.

According to another embodiment, a helmet assembly includes a helmet. A mouthpiece assembly is supported by the helmet such that the mouthpiece assembly is disposed in a face region of the helmet. The mouthpiece assembly has a microphone and a mouthpiece defining a passageway configured to supply fluid to a user.

DETAILED DESCRIPTION

While it should be understood that the inventions described herein are described in connection with particular examples, the scope of the inventions are not limited to the specific examples. Rather, those skilled in the art will appreciate after reviewing the present disclosure that the following teachings can be used in a much wider variety of applications than the examples specifically mentioned herein.

Figure 1:
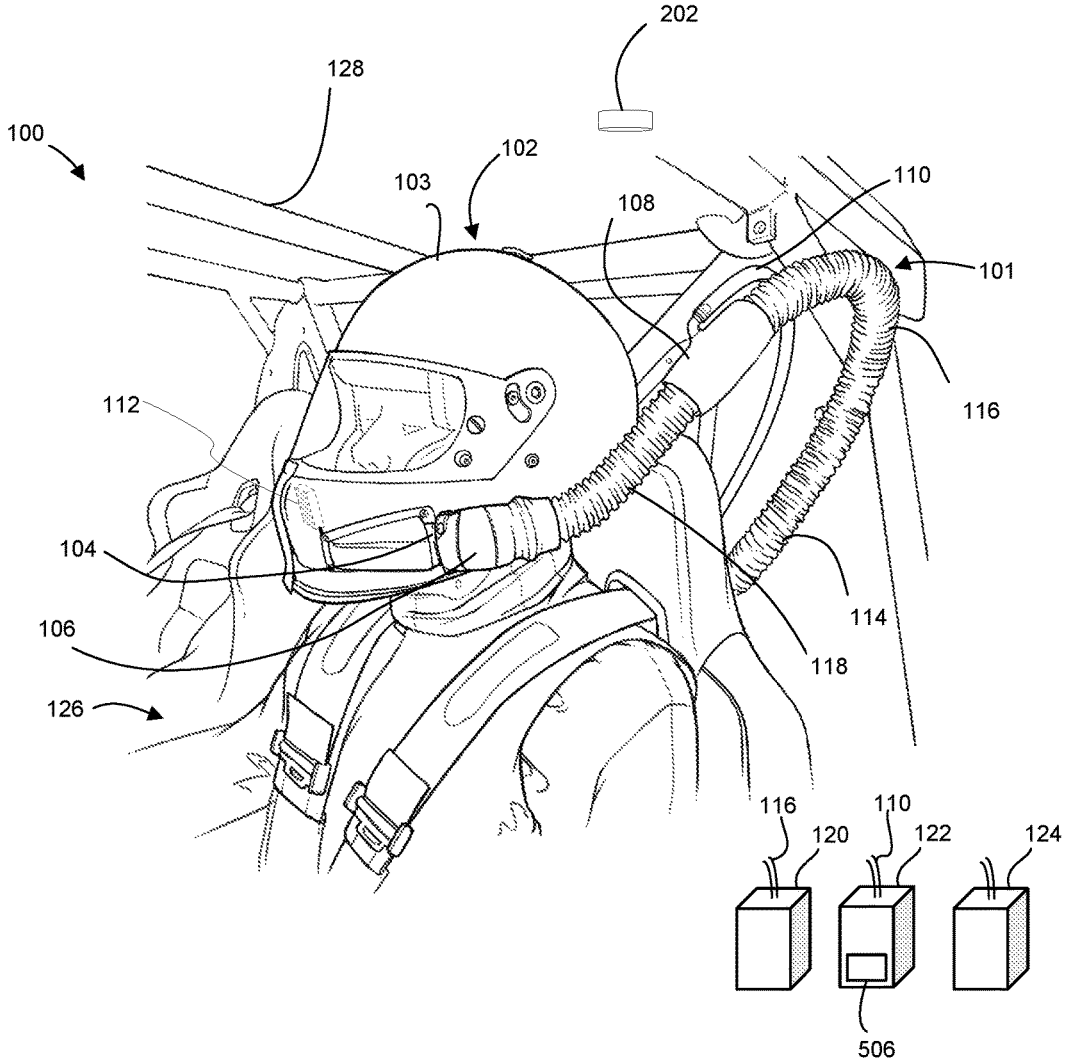
FIG. 1 illustrates an exemplary race car with a personal hydration and air cooling system that includes a two-channel fluid delivery system.
Figures 2A, 2B:
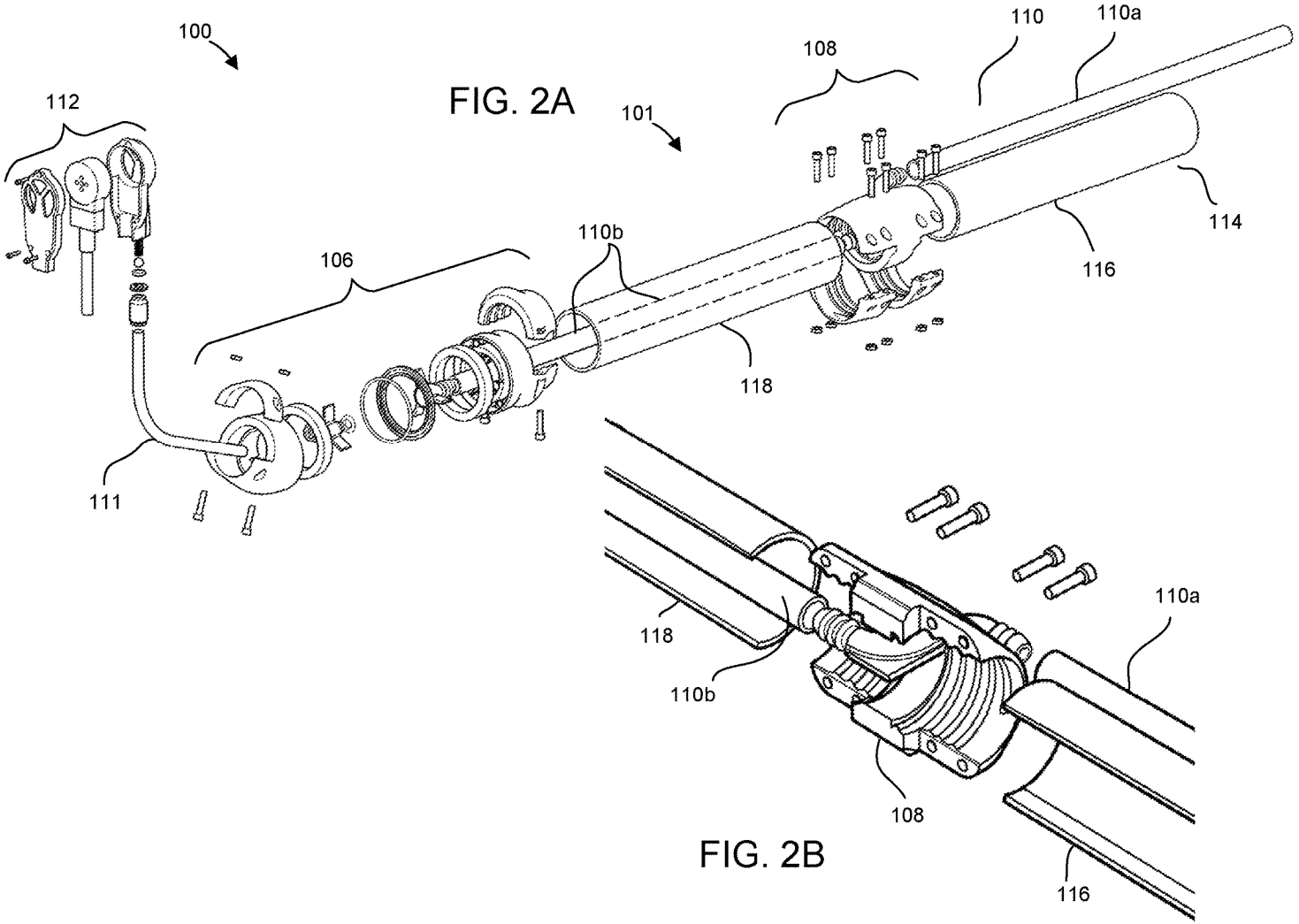
FIG. 2A is an exploded perspective view of a personal hydration and air cooling system with a two-channel fluid delivery system that includes a mouthpiece assembly, magnetic quick connect, tubing defining a first fluid channel for carrying a first fluid, and a splicer for introducing a second fluid into the tubing.
FIG. 2B is a cross-sectional perspective view of the splicer and tubing of the fluid delivery system of FIG. 2A.

Referring now to the drawings in which like reference numerals designate like or corresponding components throughout the drawings, there is shown in FIGS. 1 and 2 a personal hydration and air cooling system 100 according to the present disclosure. The hydration and air cooling system 100 includes a number of distinct aspects. Distinct aspects of the hydration and air cooling system 100 include, for example, a fluid delivery system 101, a headgear assembly 102 having a helmet 103 with a helmet interface 104, a mouthpiece assembly 112, a magnetic quick connect 106, a tube 114 having first and second tubing portions 116, 118, and a splicer 108.

It is to be expressly understood that each of these various aspects, as well as other inventive features of the hydration and air cooling system 100 described below, both individually as well as in combination, all form distinct and separately patentable inventions contemplated by the present disclosure. Thus, for example, while each of these distinct aspects have all been incorporated into an illustrative embodiment of a hydration and air cooling system 100, it is to be expressly understood that because each of these aspects are separately patentable, they can be used individually or collectively in many other hydration systems, air delivery systems, and/or fluid delivery systems without departing from the spirit of the present disclosure. Thus, it is also to be expressly understood that the present patent disclosure is not restricted to the fluid delivery system embodiments described herein. Indeed, as will become apparent to those skilled in the art after reviewing the present disclosure, one or more aspects of the hydration and air cooling system 100 may readily be incorporated into other vehicles, personal hydration systems and/or fluid delivery systems without departing from the scope of the present disclosure. By way of illustration, but not limitation, the magnetic quick connects of the present disclosure, may, for example, be used in a host of fluid delivery systems unrelated to personal hydration systems, including in gas delivery systems, such as a variety of powered or supplied air delivery respirator systems. Furthermore, although shown on only the driver side of the vehicle 128, one or more hydration and air cooling systems 100 may be provided at any suitable location of the vehicle 128, such as at a passenger side or rear seat.

As discussed in greater detail herein, the personal hydration and air cooling system 100 includes a fluid delivery system 101 and one or more fluid sources (e.g., first fluid source 120 and second fluid source 122), and may further include an audio source (e.g., audio source 124). The fluid delivery system 101 includes everything downstream of the fluid sources 120, 122.

The fluid and audio sources may be supported directly or indirectly on the frame of a vehicle 128 without the user 126 having to carry the fluid and/or audio sources on his or her person. In particular, FIG. 1 illustrates a user 126 driving a vehicle 128 in the form of a race car. The fluid and/or audio sources may be disposed within the cabin of vehicle 128 so as to be supported directly or indirectly by the frame of the vehicle 128 at a location behind the user 126.

Referring to FIG. 1, a primary fluid delivery tube 114 has a first tube portion 116 and a second tube portion 118. The first tube portion 116 is connected at one end to a first fluid source 120. The first fluid source is preferably an air source, and may include a fan to move air to the user. The air may be drawn from the ambient air or may be drawn from an air reservoir. The first fluid source 120 may be used to provide air to a user 126. Providing air to user 126 may be desirable to provide a source of cooling for user 126. In some applications, providing filtered or clean air to user 126 will also ensure user 126 has a source of clean air to breathe, thereby limiting the inhalation of undesirable gasses or particles, such as dust particles, by user 126 during a race or other activity. In this way, the hydration and air cooling system 100 is provided with an air subsystem that supplies a source of cooling, as well as a source of breathable air to the user 126. A filter or other media may be included at any suitable portion of air subsystem of the hydration and air cooling system 100 to improve the quality of the air supplied to the user 126. For example, if source 120 comprises a fan, then a filter may be provided at the inlet to the fan.

The first tube portion 116 is connected at the other end to a splicer 108. As discussed in greater detail elsewhere herein, the splicer 108 includes a connector adapted to receive a portion of hydration input tube 110, namely tubing conduit 110*a*, to deliver a hydration liquid to mouthpiece assembly 112 of headgear assembly 102. The second tube portion 118 is connected at one end to the splicer 108 and at the other end to a magnetic quick connect 106. The magnetic quick connect 106 is secured at one end to headgear assembly 102. More particularly, the magnetic quick connect 106 is secured at one end to the helmet interface 104 of helmet 103. Interposing the magnetic quick connect 106 into the fluid delivery path of fluid delivery system 101 allows the upstream components of the fluid delivery system 101 to readily be attached to and detached from downstream components of the fluid delivery system 101.

Figure 3A:
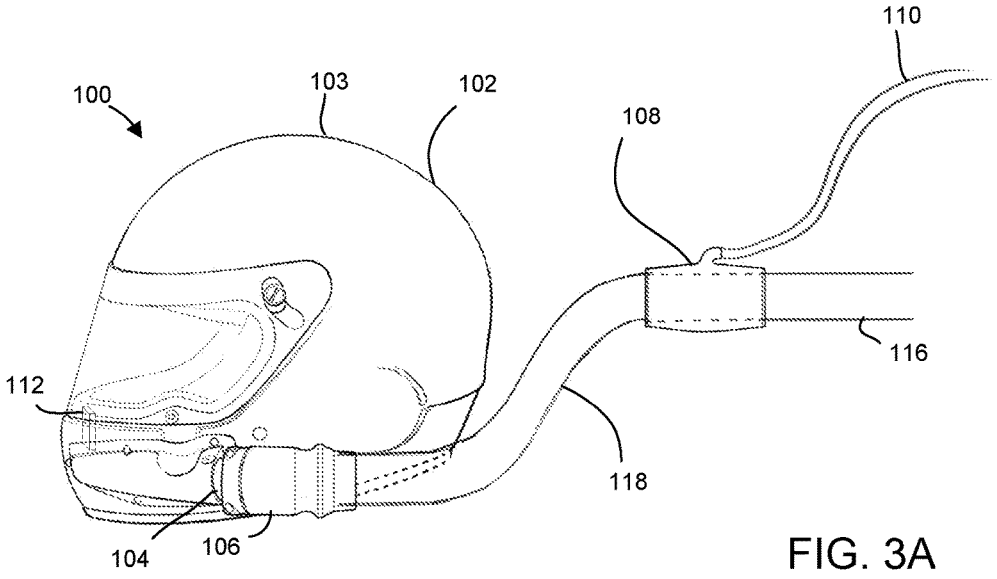
FIG. 3A illustrates an exemplary two-channel fluid delivery system helmet configuration.
Figure 3B:
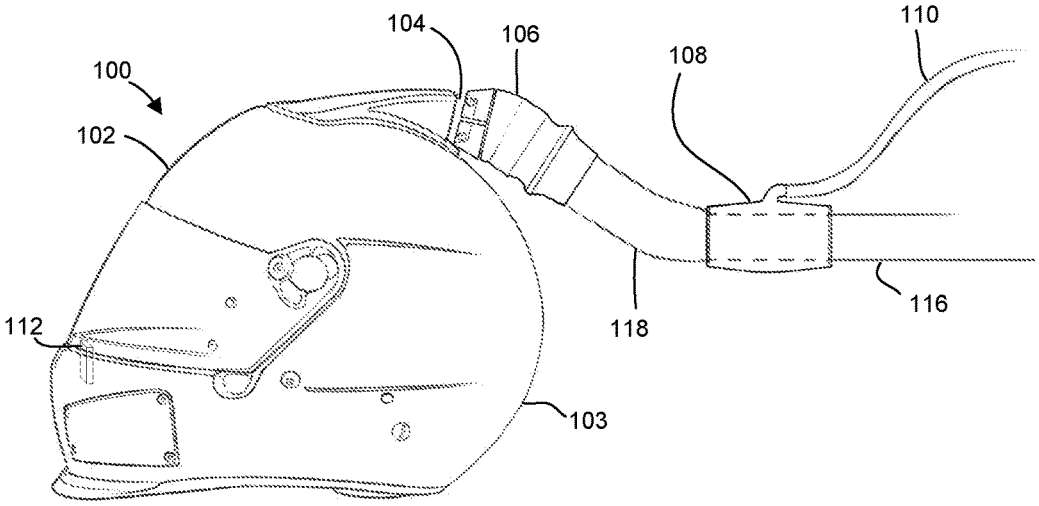
FIG. 3B illustrates another exemplary two-channel fluid system helmet configuration.

The magnetic quick connect 106 may be secured to a helmet interface 104 at a lower region of the helmet 103 as shown in in FIGS. 1 and 3A, or may be secured to an upper region of the helmet 103 as shown in FIG. 3B.

In some approaches, the magnetic quick connect 106 is coupled directly to the helmet 103 at the helmet interface 104. For example, the helmet interface 104 may include an input tube, and the magnetic quick connect 106 may be coupled to the input tube of the helmet interface 104. In still other approaches, described in greater detail elsewhere herein, a helmet-side portion of the magnetic quick connect 106 may be integrated directly into the helmet interface 104 of helmet 103. Those skilled in the art will also appreciate from reviewing the present patent document that a wide variety of potential applications exist for the liquid subsystem, air subsystem or both subsystems of the fluid delivery system 101. Further, many of the applications do not involve the fluid delivery system 101 being attached to a full-face helmet 103. Indeed, a user can use aspects of the fluid delivery system 101 according to the present patent document in a wide variety of non-helmeted and/or non-vehicle related applications. It is expressly contemplated that the hydration and air cooling system 100 may be used with a variety of headgear assemblies 102. An illustrative potential application of the two-channel fluid delivery system 101 includes, for example, fire fighter helmets equipped with a powered or supplied air respirator. Other protective systems, including safety helmets, welding helmets, face shields, chemical suits, bio-hazard suits, hoods, and headcovers configured to be connected to a powered or supplied air respirator system are also potential applications, as the two-channel fluid delivery system 101 of the present patent disclosure will allow the users of such systems to also be hydrated where those current systems presently lack a hydration option. Even if the hydration feature of fluid delivery system 101 is not desired for the users of those protective systems, however, the magnetic quick connect 106 may be interposed in the powered or supplied air delivery system of those protective systems to allow advantages in the coupling and uncoupling of the downstream components to the upstream components in the air delivery systems.

Aspects of the liquid subsystem of fluid delivery system 101 may likewise be used without the air subsystem. For example, a wide variety of helmets may be used to form a headgear assembly 102 of the present patent disclosure, including, but not limited to, motorcycle helmets (half, three quarter, open face, and full face), auto racing helmets (open face or full face), cycling helmets, skateboarding helmets, snowboarding and skiing helmets, mountain climbing helmets, military and other tactical helmets, fire helmets, safety helmets, and rescue helmets. The headgear assemblies 102 of the present patent disclosure may also be formed with headgear other than a helmet 103, such as with a head bracket. Illustrative potential applications of non-helmet-based headgear assemblies include, by way of example, backpackers, joggers, hikers, climbers, workers, firefighters, police, and military personnel.

Figure 4A:
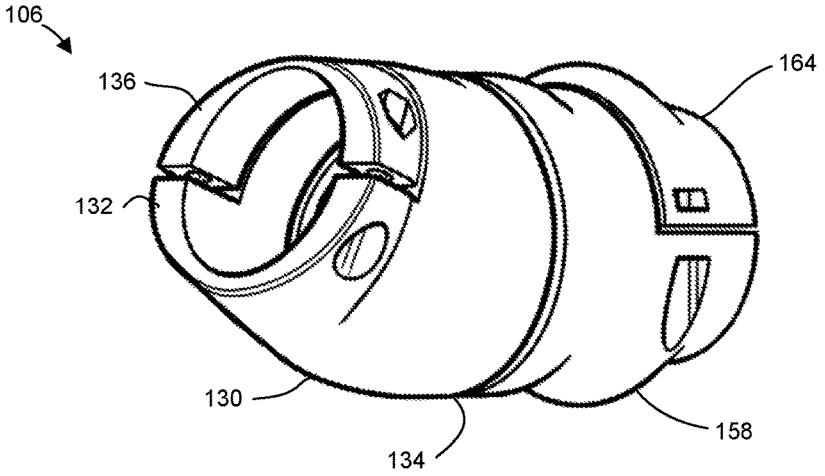
FIG. 4A is a perspective view of a magnetic quick connect.
Figure 4B:
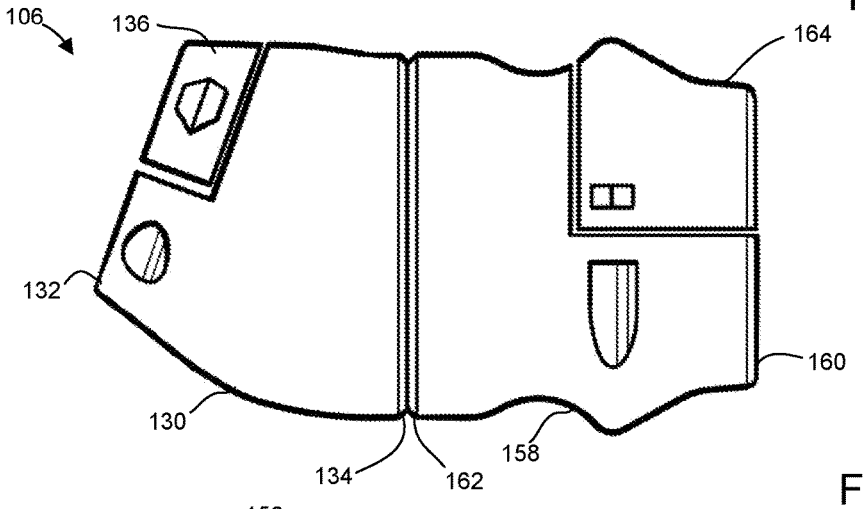
FIG. 4B is a side elevation view of the magnetic quick connect of FIG. 4A.
Figure 4C:
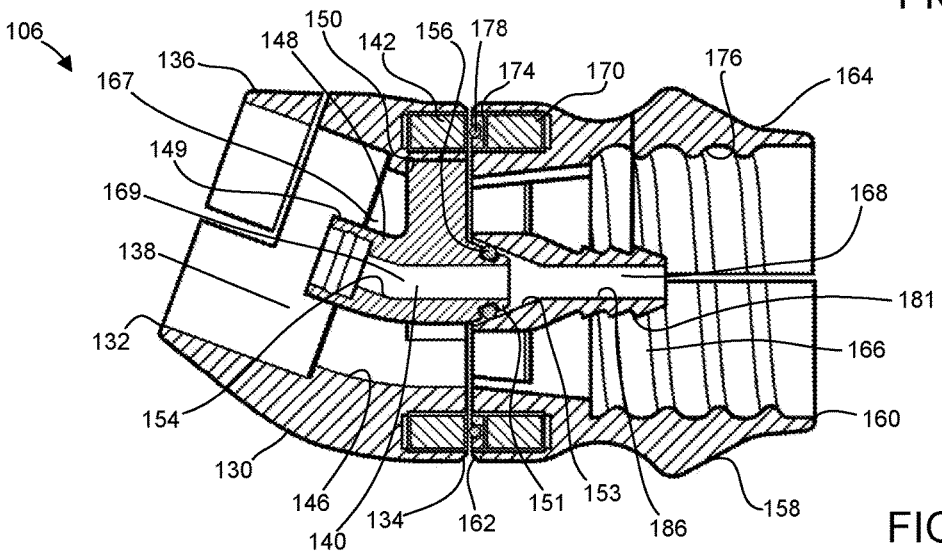
FIG. 4C is a sectioned side elevation view of the magnetic quick connect of FIG. 4A.

Referring now to FIGS. 4A-4C, the magnetic quick connect 106 includes a male coupling member 130 and a female coupling member 158. It is expressly contemplated that the features described herein with respect to the male coupling member 130 and the female coupling member 158 may be incorporated in either of the male coupling member 130 or the female coupling member 158. Further, the position of the male coupling member 130 and the female coupling member 158 may be reversed from that illustrated in FIG. 4A-4C. Thus, for example, the coupling members of the magnetic quick connect 106 may be referred generically to the downstream coupling member and upstream coupling member.

The male coupling member 130 has a first end 132 and a second mating end 134. The male coupling member 130 further includes an adjustable clamp portion 136. The adjustable clamp portion 136 may take the form of a "C-clamp", and may be removably connectable to the male coupling member 130, for example, through the use of screws or other fastening devices. In this way, the adjustable clamp portion 136 allows the male coupling member 130 to be secured to helmet interface 104 of helmet 103. For example, a user may remove the adjustable clamp portion 136 and position a tubing, such as an input tube, of the helmet interface 104 within the body of the male coupling member 130. The user then reconnects the adjustable clamp portion 136 to the male coupling member 130, thereby securing the male coupling member 130 to the helmet interface 104 of helmet 103. Other suitable mechanisms and fastening devices for securing the male coupling member 130 to a helmet 103 are expressly contemplated herein.

As shown in FIG. 4C, an outer fluid communication path 138 extends from the first end 132 to the second mating end 134 of the male coupling member 130. In a preferred approach, discussed in greater detail elsewhere herein, an inner fluid communication path 140 extends from the second mating end 134 into the male coupling member 130.

Figure 5:
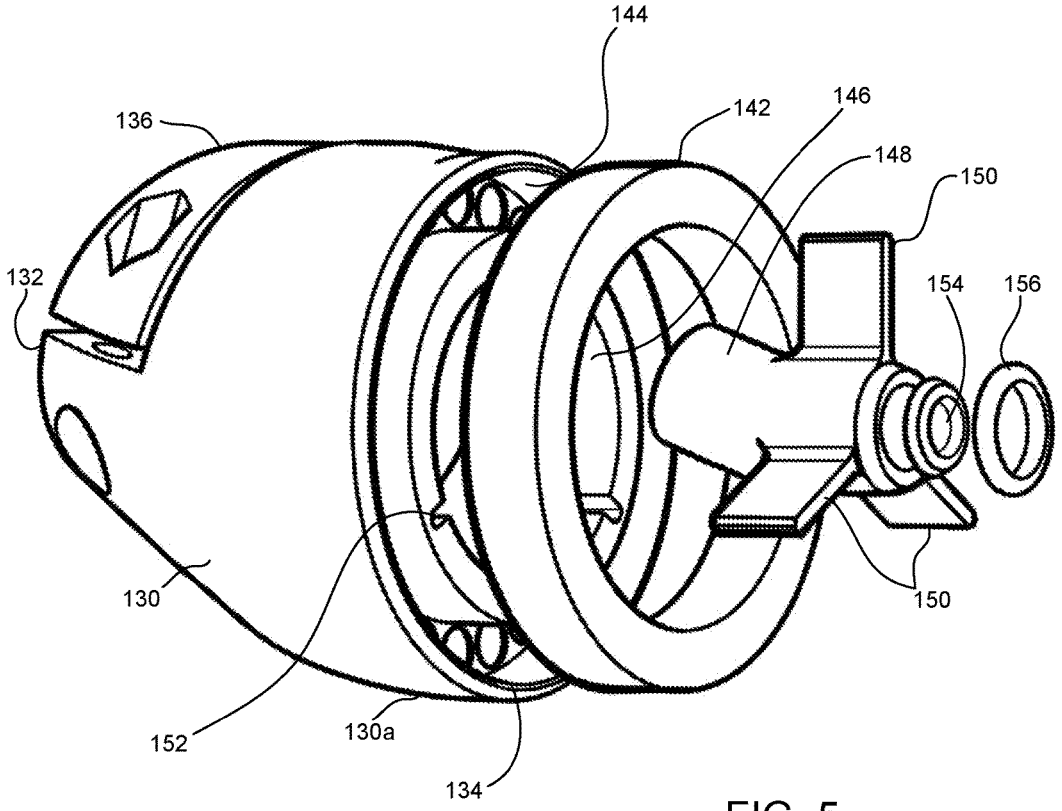
FIG. 5 is a perspective exploded view of the male coupling member of the magnetic quick connect of FIG. 4A.

Referring momentarily to FIG. 5, the male coupling member 130 includes a first magnetic material 142 disposed in a cavity 144. The first magnetic material 142 may be secured within the cavity 144 using glue or any other suitable securing fastener or adhesive.

The male coupling member 130 further includes an outer path wall 146 defining the outer fluid communication path 138. In a preferred approach, the outer fluid communication path 138 provides for the flow of atmospheric air or supplied air from first source 120 through the male coupling member 130.

The male coupling member 130 further includes an inner member 148 disposed within the outer fluid communication path 138. In a preferred approach, the inner member 148 is removably splined to the outer path wall 146. For example, the inner member 148 may be provided with one or more, and preferably three, fins 150 that are adapted to engage grooves 152 disposed in the outer path wall 146. The engagement of the fins 150 in the grooves 152 serves to hold the inner member 148 in place within the male coupling member 130. The inner member 148 may be held in place through any suitable approaches. For example, when the inner member 14 is intended to be a removable inner member 148, the fins 150 may form an interference fit with the grooves 152. When the inner member 148 is intended to remain within the male coupling member 130, an adhesive may be used to secure the fins 150 to the grooves 152. In still other approaches, the inner member 148 may be integrally formed with the male coupling member 130.

The inner member 148 defines an inner path wall 154 defining the inner fluid communication path 140. In a preferred approach, the inner fluid communication path 140 provides for the flow of water or other hydration liquids from source 122 through the male coupling member 130. In some approaches, the inner member 148 includes a receiving portion 149 adapted to receive a tubing conduit 111 within the receiving portion 149. In other approaches (not shown), the inner member 148 includes a barbed portion adapted to receive a tubing conduit 111 about the barbed portion. The tubing conduit may be connected to, for example, the mouthpiece assembly 112.

In a preferred approach, the inner member 148 provides an inner fluid communication path 140 that is coaxial with the outer fluid communication path 138 defined by the outer path wall 146. The coaxial disposition of the inner member 148 within the male coupling member 130 may be provided, for example, by the fins 150. In this way, the inner member 148 provides communication of a first fluid (e.g., water or other hydration liquid) through the inner fluid communication path 140, while the male coupling member 130 provides communication of a second fluid (e.g., air) through the outer fluid communication path 138.

While in the approach shown in FIGS. 4C and 5, the inner fluid communication path 140 of inner member 148 is coaxial with the outer fluid communication path 138 defined by the outer path wall 146, in other approaches, the inner fluid communication path 140 is not coaxial with the outer fluid communication path 138. In such approaches, a central axis of the inner fluid communication path 140 is axially offset with respect to a central axis of the outer fluid communication path 138. In a further example, the inner fluid communication path 140 may be defined by an inner path wall 154 that is disposed in proximity to, adjacent to, or in contact with an outer path wall 146 defining the outer fluid communication path 138.

In a preferred approach, the inner member 148 of the male coupling member 130 includes a protrusion 151 for engaging a corresponding recess 153 of an inner member 180 of the female coupling member 158, as discussed in greater detail elsewhere herein. In particularly preferred approaches, the protrusion 151 is tapered and the wall defining recess 153 has a corresponding taper.

In one approach, the inner member 148 is formed integrally with, or permanently secured to, the outer path wall 146 of the male coupling member 130 such that the inner member 148 and the male coupling member 130 define a unitary piece.

In another approach, the inner member 148 is adapted to be removably connectable to the male coupling member 130. For example, the fins 150 of the inner member 148 may be removably insertable into the grooves 152 of the outer path wall 146. The male coupling member 130 may further be provided with a locking mechanism to secure the inner member 148 in place within the male coupling member 130. Such a locking mechanism may provide for slight rotation of the inner member 148 relative to the outer path wall 146 of male coupling member 130 to secure the fins 150 of the inner member 148 against one or more locking tabs. In this way, a user may insert the inner member 148 into the male coupling member 130 when the user desires dual fluid flow to a helmet 103, and may remove the inner member 148 from the male coupling member 130 when dual fluid flow is not desired or unavailable.

In one approach, the male coupling member 130 is removably secured to the helmet interface 104 of helmet 103. In other approaches, a helmet-side coupling member (male or female) of the magnetic quick connect 106 is integrally formed with the helmet 103. For example, male coupling member 130 may be integrated with the helmet 103, thus providing helmet 103 with a helmet-integrated magnetic quick connect interface having an outer fluid communication path 138, and optionally an inner fluid communication path 140 disposed within the outer fluid communication path 138, and a first magnetic material 142 for detachably coupling with a tubing-side or upstream coupling member (e.g., a female coupling member 158), thereby forming a magnetic quick connect 106. In this way, the helmet-integrated magnetic quick connect interface may perform in substantially the same manner as the male coupling member 130 described herein. The helmet-integrated magnetic quick connect interface reduces the number of components within the fluid delivery system.

The magnetic quick connect 106 further includes a female coupling member 158 having a first end 160 and a second mating end 162. The second mating end 162 of the female coupling member 158 is adapted to be secured (e.g., magnetically secured) to second mating end 134 of the male coupling member 130, as discussed in greater detail elsewhere herein.

The female coupling member 158 includes an adjustable clamp portion 164. Similar to the adjustable clamp portion 136 of the male coupling member 130, the adjustable clamp portion 164 of the female coupling member 158 may take the form of a "C-clamp", and may be removably connectable to the female coupling member 158, for example, through the use of screws or other fastening devices. In this way, the adjustable clamp portion 164 allows the female coupling member 158 to be secured to a tubing such as tubing portion 118. For example, a user may remove the adjustable clamp portion 164 and position tubing portion 118 within the body of the female coupling member 158. The user may then reconnect the adjustable clamp portion 164 to the female coupling member 158, thereby securing the tubing portion 118 to the female coupling member 158. Other suitable mechanisms and fastening devices for securing tubing to the female coupling member 158 are expressly contemplated herein.

As shown in FIG. 4C, an outer fluid communication path 166 extends from the first end 160 to the second mating end 162 of the female coupling member 158. In a preferred approach, discussed in greater detail elsewhere herein, an inner fluid communication path 168 extends from the second mating end 162 into the female coupling member 158.

Figure 6:
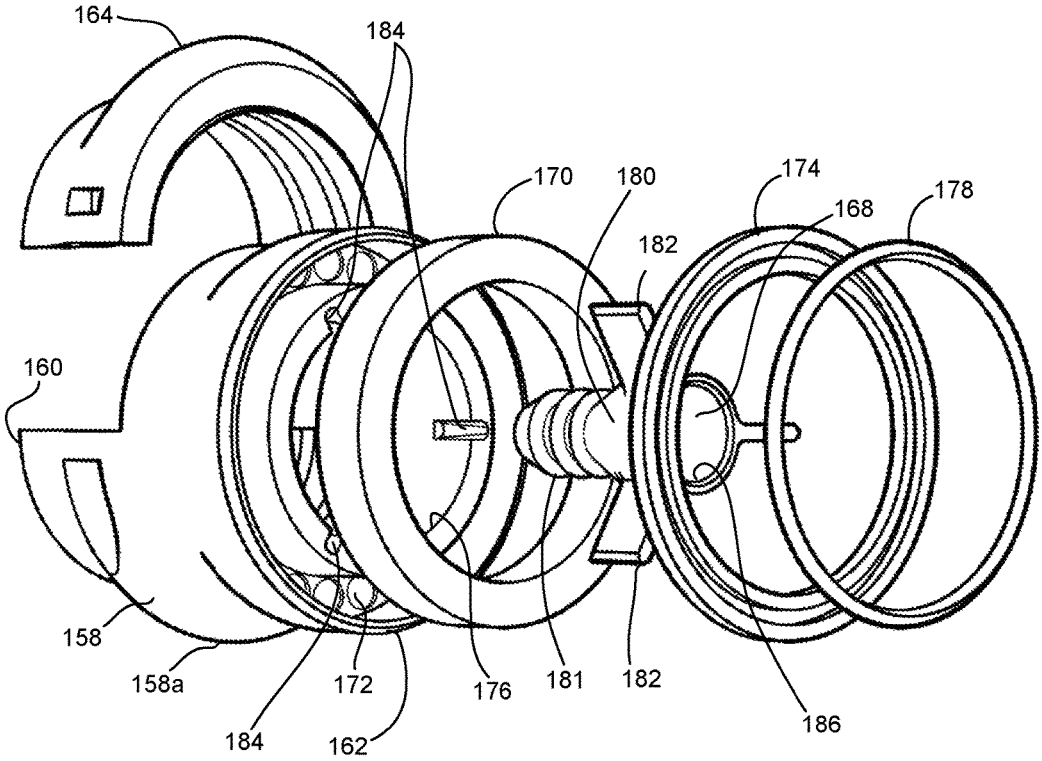
FIG. 6 is a perspective exploded view of the female coupling member of the magnetic quick connect of FIG. 4A.
Figure 7A:
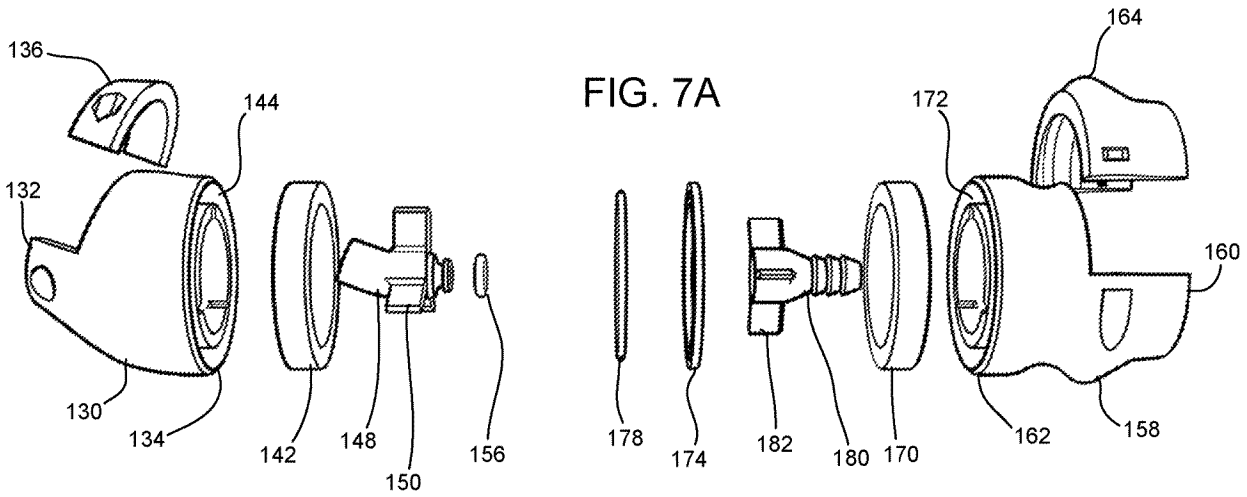
FIG. 7A is a side elevation exploded view of the magnetic quick connect of FIG. 4A.
Figure 7B:
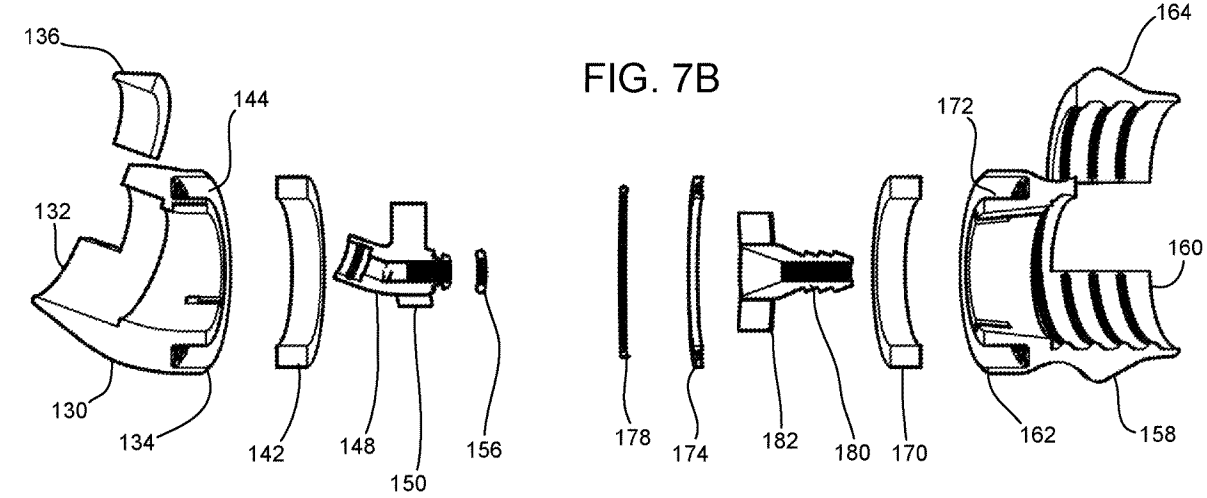
FIG. 7B is a sectioned side elevation exploded view of the magnetic quick connect of FIG. 4A.
Figure 8A:
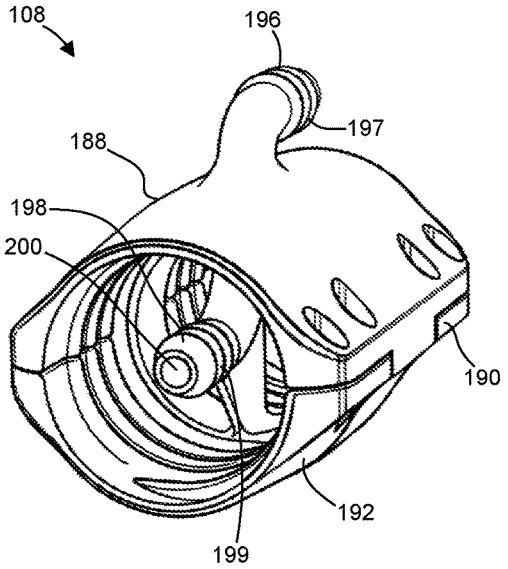
FIG. 8A is a perspective view of a splicer.
Figure 8B:
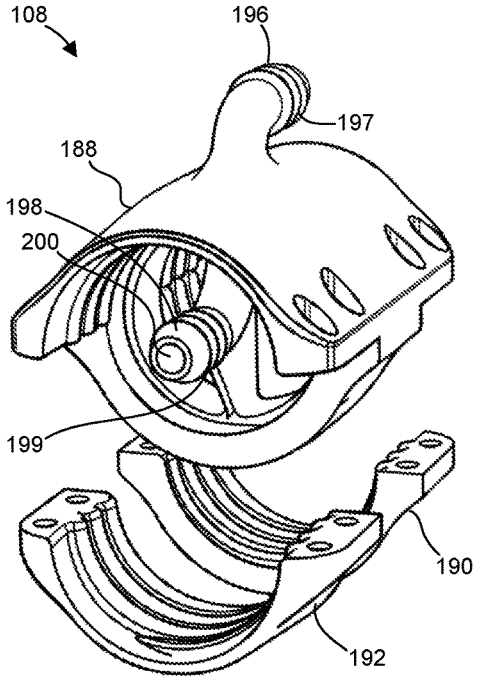
FIG. 8B is an exploded perspective view of the splicer of FIG. 8A.
Figure 8C:
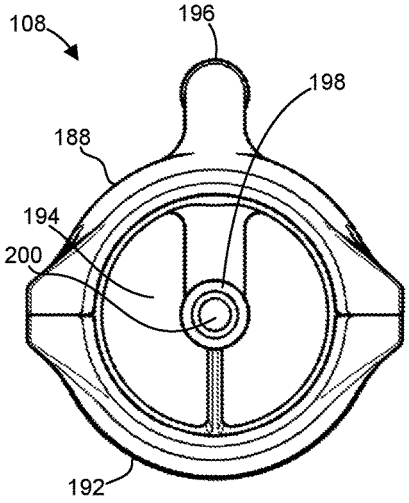
FIG. 8C is a front elevation view of the splicer of FIG. 8A.
Figure 8D:
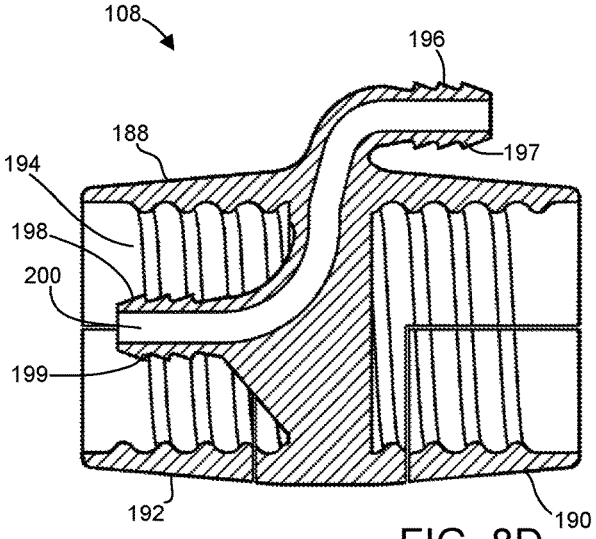
FIG. 8D is a sectioned side elevation view of the splicer of FIG. 8A.

Referring momentarily to FIG. 6, the female coupling member 158 includes a second magnetic material 170 disposed in a cavity 172. The second magnetic material 170 may be secured within the cavity 172 using glue or any other suitable securing fastener or adhesive. The second magnetic material 170 may be the same as or similar to the first magnetic material 142 of the male coupling member 130. The first and second magnetic materials may comprise a material selected from the group consisting of a ferromagnetic material and ferrimagnetic material. Preferably at least one of the first and second magnetic materials are a permanent magnet. The first and second magnetic materials 142, 170 are selected to have sufficient magnetic properties so that the magnetic force of attraction between them will detachably hold the male coupling member 130 and female coupling member 158 together, preferably with sufficient force to compress O-ring 178 sufficiently to provide a gas tight, or substantially gas tight, seal. As a result, the male and female coupling members 130, 158 of the magnetic quick connect 106 may be quickly and repeatedly connected and disconnected from one another.

The female coupling member 158 further includes an outer path wall 176 defining the outer fluid communication path 166. In a preferred approach, the outer fluid communication path 166 provides for the flow of atmospheric air or supplied air from first source 120 through the female coupling member 158.

The outer fluid communication path 166 of the female coupling member 158 is dimensioned and oriented to provide fluid communication with the outer fluid communication path 138 of the male coupling member 130, as shown for example in FIG. 4C.

The female coupling member 158 further includes an inner member 180 disposed within the outer fluid communication path 166. In a preferred approach, the inner member 180 is removably splined to the outer path wall 176. For example, the inner member 180 may be provided with one or more, and preferably three, fins 182 that are adapted to engage grooves 184 disposed in the outer path wall 176. The engagement of the fins 182 in the grooves 184 serves to hold the inner member 180 in place within the male coupling member 158.

The inner member 180 defines an inner path wall 186 defining the inner fluid communication path 168. In a preferred approach, the inner fluid communication path 168 provides for the flow of water or other hydration liquids from source 122 through the female coupling member 158. In some approaches, the inner member 180 includes a barbed portion 181 adapted to receive one end of tubing conduit 110*b* about the barbed portion 181. In other approaches, the inner member 180 may include a receiving portion adapted to receive the end of tubing conduit 110*b* within the receiving portion, similar to receiving portion 149 of male coupling member 130. The other end of tubing conduit 110*b* may be connected to, for example, an outlet nozzle 198 of the splicer 108, as discussed in greater detail elsewhere herein.

In a preferred approach, the inner member 180 provides an inner fluid communication path 168 that is coaxial with the outer fluid communication path 166 defined by the outer path wall 176. The coaxial disposition of the inner member 180 within the female coupling member 158 may be provided, for example, by the fins 182. In this way, the inner member 180 provides communication of a first fluid (e.g., water or other hydration liquid) through the inner fluid communication path 168, while the female coupling member 158 provides communication of a second fluid (e.g., air) through the outer fluid communication path 166.

While in the approach shown in FIGS. 4C and 6, the inner fluid communication path 168 of inner member 180 is coaxial with the outer fluid communication path 166 defined by the outer path wall 176, in other approaches, the inner fluid communication path 168 is not coaxial with the outer fluid communication path 166. In such approaches, a central axis of the inner fluid communication path 168 is axially offset with respect to a central axis of the outer fluid communication path 176. In a further example, the inner fluid communication path 168 may be defined by an inner path wall 186 that is disposed in proximity to, adjacent to, or in contact with an outer path wall 176 defining the outer fluid communication path 166. However, the male and female coupling members 130 and 158 should be configured so that when they are coupled together, the outer fluid communication paths 138, 166 are in fluid communication with one another and the inner fluid communication paths 140, 168 are in fluid communication with one another, but so that the outer fluid communication paths 138, 166 and inner fluid communication paths 140, 168 are separated from one another.

As shown in FIG. 4C, in a preferred approach, the inner member 180 of the female coupling member 158 includes a recess 153 for receiving a corresponding protrusion 151 of the inner member 148 of the male coupling member 130. In a particularly preferred approach, the recess 153 is tapered and the protrusion 151 has a corresponding taper.

The angle of taper is preferably in the range of 15° to 50° from the axis of the protrusion, more preferably, in the range of 20° to 40°, and even more preferably 25° to 35°. Tapering the protrusion 151 and protrusion receiving area, or recess 153, in this manner, helps the male and female coupling members to be self-centering with respect to one another. It also allows the quality of the seal between the O-ring 156 and the protrusion receiving surface to be increased.

To provide a liquid-tight or substantially liquid-tight seal between the male and female coupling members 130, 158, protrusion 151 on the inner member 148 may be provided with an O-ring 156. O-ring 156 is positioned and sized so that it will be compressed between protrusion 151 and the wall defining recess 153 when the male and female coupling members 130, 158 are coupled together.

To provide an airtight or substantially airtight seal between the male and female coupling members 130, 158, an O-ring 178 may be provided so that it is compressed between the two mating ends 134, 162 of the male and female coupling members 130, 158, respectively. Preferably the O-ring 178 is positioned so that when the male and female coupling members 130, 158 are coupled together it is compressed at an annular region between the outer path wall 146 of the outer fluid communication path 138 and the outer surface 130*a* of the male coupling member 130 and an annular region between the outer path wall 176 of outer fluid communication path 166 and the outer surface 158*a* of the female coupling member 158. O-ring 178 may be provided on the mating end of either male or female coupling member 130, 158, respectively. However, in the illustrated embodiment, it is disposed on the cap 174 provided at the mating end 162 of female coupling member 158. As best seen in FIG. 6, O-ring 178 is preferably disposed in an annular groove provided in cap 174.

Adhesive may be used to hold O-ring 178 within the annular groove. More desirably, the annular groove is C-shaped, so that the opening of the groove is narrower than the O-ring's diameter. This way the walls of the groove will hold the O-ring within cap 174. The C-shaped groove may be formed in cap 174 by 3D printing the cap, or alternatively using two concentric rings as described below in connection with FIGS. 27-28, and 47-49.

In one approach, the inner member 180 is formed integrally with, or permanently secured to the outer path wall 176 of the female coupling member 158 such that the inner member 180 and the female coupling member 158 define a unitary piece.

In another approach, the inner member 180 is adapted to be removably connectable to the female coupling member 158. For example, the fins 182 of the inner member 180 may be removably insertable into the grooves 184 of the outer path wall 176. The female coupling member 158 may further be provided with a locking mechanism to secure the inner member 180 in place within the female coupling member 158. Such a locking mechanism may provide for slight rotation of the inner member 180 relative to the outer path wall 176 of female coupling member 158 to secure the fins 182 of the inner member 180 against one or more locking tabs. In this way, a user may insert the inner member 180 into the female coupling member 158 when the user desires dual fluid flow to a helmet 103, and may remove the inner member 180 from the female coupling member 158 when dual fluid flow is not desired or unavailable.

While in the illustrated embodiment, the downstream end of magnetic quick connect 106 comprises a male coupling member 130, in other embodiments the downstream end of the magnetic quick connect 106 may comprise a female coupling member 158.

In the illustrated approach, magnetic quick connect 106 forms the proximal end of headgear assembly 102, but in other approaches, magnetic quick connect 106 may be interposed in the fluid delivery paths of fluid delivery system 101 in a different location. Moreover, in some approaches, a second magnetic quick connect may be included in one or both of the fluid delivery paths defined by fluid delivery system 101.

When connected, the male coupling member 130 and the female coupling member 158 collectively form the magnetic quick connect 106. Alignment of the male coupling member 130 and the female coupling member 158 may be facilitated by aligning the inner member 148 of the male coupling member 130 with the inner member 180 of the female coupling member 158. As shown, for example, in FIG. 4C, the inner member 180 of the female coupling member 158 may include a tapered recess 153 adapted to receive a tapered (e.g., conical) protrusion 151 of the inner member 148, as well as the O-ring 156, of the male coupling member 130. The angle of taper is preferably set in the range previously described.

As also shown, for example, in FIG. 4C, when connected, the outer fluid communication path 138 of the male coupling member 130 is in fluid communication with the outer fluid communication path 166 of the female coupling member 158. In this way, a fluid such as air may flow freely through a first fluid communication channel 167—that includes the outer fluid communication paths 138, 166 of the magnetic quick connect 106—to communicate the air from an air source (e.g., first fluid source 120) to the headgear assembly 102.

Similarly, when connected, the inner fluid communication path 140 of the male coupling member 130 is in fluid communication with the inner fluid communication path 168 of the female coupling member 158. In this way, a second fluid, such as water or other hydration liquid, may flow freely through a second fluid communication channel 169—that includes the inner fluid communication paths 140, 168 of the magnetic quick connect 106—to communicate the hydration liquid from a source (e.g., second fluid source 122) to the headgear assembly 102.

The male and female coupling members 130, 158 of the magnetic quick connect 106 may be configured to permit a user 126 to couple and uncouple the coupling members 130, 158 and their associated components with a single hand and without actually viewing the coupling members 130, 158 when they are to be coupled together or uncoupled. For example, the male and female coupling members 130, 158, may be configured so that magnetic force of attraction between the two coupling members 130, 158 is such that the user 126 need only bring the two coupling members into proximity with (although not necessarily even touching) one another and the magnetic force of attraction between the two coupling members 130, 158 will automatically align and couple the members 130, 158 together in a fluid tight manner. As a result, user 126 need not be able to visualize the male and female coupling members 130, 158 of magnetic quick connect 106 when coupling or uncoupling them. Furthermore, as the strength of the magnetic force of attraction between the coupling members 130, 158 is increased, then user 126 will not need to bring the coupling members 130, 158 as close together in order for the magnetic force of attraction between the two coupling members 130, 158 to automatically align and couple the members 130, 158 together in a fluid tight manner.

The user 126 can also rely on the haptic feedback provided by the magnetic force of attraction between the two coupling members 130, 158 to know when he or she has brought female coupling member 158 sufficiently close to, and sufficiently aligned with, male coupling member 130 so as to release female coupling member 158 and allow the magnetic force of attraction between the two coupling members 130, 158 to finish aligning and coupling the members 130, 158 together in a fluid-tight manner. The strength of the magnetic force of attraction between the two coupling members 130, 158 can also be set so that when the two coupling members 130, 158 couple together as a result of the magnetic force of attraction that a distinct, audible noise, such as an audible "clacking" noise, will be made due to the two coupling members coming together in a fluid-tight manner. As a result, user 126 can listen for the clacking or other distinct noise to verify that coupling members 130, 158 have been properly coupled together in a fluid-tight manner without ever visualizing the two coupling members when coupling them together.

Furthermore, the inclusion of a magnetic quick connect 106 in the fluid delivery path of fluid delivery system 101 also substantially increases the safety of fluid delivery system 101 over conventionally known hydration system designs for a wide variety of uses or applications. For example, while the male and female coupling members 130, 158 may be configured so that magnetic force of attraction between the two coupling members 130, 158 is sufficient to automatically align and couple the members 130, 158 together when they are brought into proximity to one another, the force of attraction may also be set so that the amount of force required to disconnect the male and female coupling members 130, 158 is such that the coupling members will disconnect without injuring the user 126 in the event that a portion of the tubing 114 is subjected to a force while the user 126 is operating the vehicle 128. Similarly, in the event the user 126 crashes the vehicle 128 or some other emergency occurs that requires user 126 to exit the cabin of the vehicle 128 quickly, the male and female coupling members 130, 158 will easily and automatically disconnect as the user 126 removes himself from the vehicle 128, or the user 126 is extracted from the vehicle 128 by a race track crew. These safety features may be particularly important in the event of a fire within the cabin of the vehicle 128 or a spinal injury to the user 126.

The magnetic force of attraction between coupling members 130, 158 may be increased, for example, by (i) increasing the thickness of the first and/or second magnetic materials 142, 170; (ii) increasing the cross-sectional area of the pole of the first and/or second magnetic materials 142, 170 that faces the other magnetic material ("the mating cross-sectional area"); (iii) increasing the flux density (B) and/or magnetization (M) of the first and/or second magnetic material 142, 170; and/or (iv) decreasing the thickness and/or magnetic permeability (μ) of any non-magnetic material between the first and second magnetic materials 142, 170 and the mating surfaces of mating ends 134, 162 of male and female coupling members 130, 158, respectively. Conversely, the magnetic force of attraction between coupling members 130, 158 may be decreased, for example, by adjusting parameters (i)-(iv) in the opposite direction.

In some approaches, an axial pull force that is greater than 48 ounce-force and less than 128 ounce-force between the male coupling member and female coupling member is required to decouple the male and female coupling members. In other approaches, an axial pull force that is greater than 64 ounce-force and less than 96 ounce-force between the male coupling member and female coupling member is required to decouple the male and female coupling members. In still other approaches, an axial pull force that is greater than 72 ounce-force and less than 88 ounce-force between the male coupling member and female coupling member is required to decouple the male and female coupling members.

Referring again to FIG. 1, the vehicle 128 may be provided with a magnetic quick connect holder 202. The magnetic quick connect holder 202 is preferably located in the vehicle 128 near a user's head (e.g., at the roof or side wall of the vehicle). The magnetic quick connect holder 202 is preferably sized to receive the female coupling member 158. Similar to the male coupling member 130, the magnetic quick connect holder 202 includes a first magnetic material for magnetically coupling with the female coupling member 158. In this way, upon disconnecting the female coupling member 158 from the male coupling member 130, the user 126 can securely couple the female coupling member 158 to the magnetic quick connect holder 202 mounted to vehicle 128 to keep the upstream portions of the magnetic quick connect 106 (and the upstream portions of fluid delivery system 101 connected thereto) readily available for the next use. Because the female coupling member 158 is maintained in a consistent, accessible manner, the magnetic quick connect holder 202 permits quick driver departure and arrival as may be required, for example, during driver changes or when a driver intends to perform maintenance on the vehicle 128. Furthermore, by securing the female coupling member 158 to the magnetic quick connect holder 202 between uses, the inner and outer fluid communication paths 168, 166 of the female coupling member 158 are effectively sealed off. In this way, dust, debris, and gasses are inhibited from entering the hose side connector 158 of the magnetic quick connect 106 between uses.

In other approaches, the female coupling member 158 may be adapted to be secured directly to the vehicle 128. This may be the case, for example, when the vehicle 128 includes a magnetic surface, such as the interior surface of a metal roll cage.

As shown in FIG. 1, the hydration and air cooling system 100 includes a second fluid source 122 for communicating a fluid to the fluid delivery system 101. The second fluid source 122 preferably comprises a potable liquid such as water or other hydration liquid, and may include a reservoir to store the potable liquid and a pump to move the potable liquid through the tube fluid delivery system 101 to the user 126. In this way, the hydration and air cooling system 100 includes a hydration subsystem that supplies a drinkable liquid to the user 126. As described in greater detail elsewhere herein, the hydration subsystem includes hydration fluid delivery or input tube 110 and headgear assembly 102, which includes mouthpiece assembly 112 supported within the helmet 103 proximate to the user's mouth. The mouthpiece 112 of headgear assembly 102 is connected in fluid communication with the second fluid source 122 via magnetic quick connect 106 and input tube 110.

In the illustrated embodiment, hydration input tube 110 includes tube conduit 110*a*, tube conduit 110*b*, and the secondary fluid channel 200 in splicer 108, which connects tube conduits 110*a*, 110*b* in fluid communication. In other embodiments, hydration input tube 110, may include additional or fewer components that make up the fluid delivery path from the source 122 to the magnetic quick connect 106.

As shown for example in FIGS. 1, 2, 3A, and 3B, to deliver the hydration liquid (e.g., water) into a second fluid communication channel 169 disposed within a first fluid communication channel 167 defined in part by the tube 114, the fluid delivery system 101 may be provided with a splicer 108 disposed in the tube 114 between tube portions 116 and 118. Splicer 108 splices or inserts the second fluid communication channel 169 within the first fluid communication channel 167. As a result, the second fluid communication channel 169 extends within, or internal to, the first communication channel 167 from the splicer 108 downstream to at least the helmet interface 104 of headgear assembly 102.

Referring now to FIGS. 8A-8D, the splicer 108 includes a splicer body 188. The splicer 108 may further include a first splicer clamp 190 and a second splicer clamp 192. Similar to the adjustable clamp portions 136, 164 of the magnetic quick connect 106, one or both of the first splicer clamp 190 and the second splicer clamp 192 may take the form of a "C-clamp", and may be removably connectable to the splicer body 188, for example, through the use of screws or other fastening devices. In this way, the first and second splicer clamps 190, 192 allow the splicer 108 to be secured to tubing; for example, tubing portions 116 and 118, respectively. In an exemplary use, a user may remove the splicer clamp portion 190 and position a tubing portion 116 adjacent splicer body 188. The user then reconnects the first splicer clamp 190 to the splicer body 188, thereby securing the tubing portion 116 to the splicer body 188. Similarly, a user may remove the second splicer clamp 192 and position a tubing portion 118 adjacent splicer body 188. The user then reconnects the second splicer clamp 192 to the splicer body 188, thereby securing the tubing portion 118 to the splicer body 188. Other suitable mechanisms and fastening devices for securing tubing to the splicer body 188 are expressly contemplated herein.

In some approaches, the splicer body 188 and splicer clamp portions 190, 192 form a plurality of ridges and grooves. The ridges and grooves may form, for example, one or more threaded regions. The one or more threaded regions may, for example, be adapted to receive tubing portions 116 and 118. In this way, the splicer clamp portions 190, 192 may be adapted to secure the tubing portions 116 and 118 to the splicer 108 via compression and friction fit forces without the need to rotate the tubing portions 116 and 118 relative to the splicer 108.

The splicer 108 defines an outer fluid communication path 194. The outer fluid communication path 194 is adapted to communicate a fluid from the first tubing portion 116 to a second tubing portion 118. For example, the splicer 108 may receive an airflow from a first tubing portion 116, and may communicate the airflow to a second tubing portion 118.

The splicer 108 may further include a secondary fluid inlet 196, a secondary fluid outlet 198, and a secondary fluid channel 200 fluidly connecting the inlet 196 with the outlet 198. Secondary fluid inlet 196 may include a hose connector such as a barbed hose connector 197 for connecting to a portion of hydration input tube 110, namely tubing conduit 110*a*, which is upstream of secondary fluid channel 200. The fluid flow may be passed through the secondary fluid outlet 198 to the secondary fluid outlet 198. The secondary fluid outlet 198 may similarly include a hose connector, such as a barbed hose connector 199 for connecting to tube 110*b* connected at one end to the secondary fluid outlet 198 and at its other end to the barbed hose connector 181 provided on the upstream end of inner member 180 of the female coupling member 158.

In some approaches, the hydration and air cooling system 100 may also include an auxiliary communication system, including audio source 124. Depending on the application, audio source 124 may, for example, comprise an intercom or two-way radio. Similar to how the second fluid communication channel 169 is introduced into the first communication channel 167 by splicer 108, one or more wires—for connecting a microphone and/or speakers of the auxiliary communication system to the audio source 124 of the auxiliary communication system—may also be introduced to the first fluid communication channel 167 of the fluid delivery system 101 at the splicer 108, or at another splicer provided in the fluid delivery system 101. The auxiliary communication system may include electrical wiring to provide electrical power to downstream components such as the microphone 254 included in mouthpiece assembly 112 and/or speakers included within helmet 103. The auxiliary communication system may also or instead provide an audio communication link to downstream components such as the microphone 254 included in mouthpiece assembly 112 or speakers. Alternatively, as is conventional, the art, wiring of the auxiliary communication system may be disposed entirely outside of the tubing 114 of the fluid delivery system 101. For example, as illustrated in FIG. 13, the applicable wiring for microphone 254 and helmet speakers of the auxiliary communication system may be introduced to helmet 103 at the bottom of the helmet between the helmet foam and wall of the helmet 103. As described in greater detail below, the microphone boom 267 of such auxiliary audio systems may be used not only to support microphone 254 of the auxiliary audio system, but it may also be used to support the mouthpiece assembly 112 of the hydration subsystem of the fluid delivery system 101.

Figure 9:
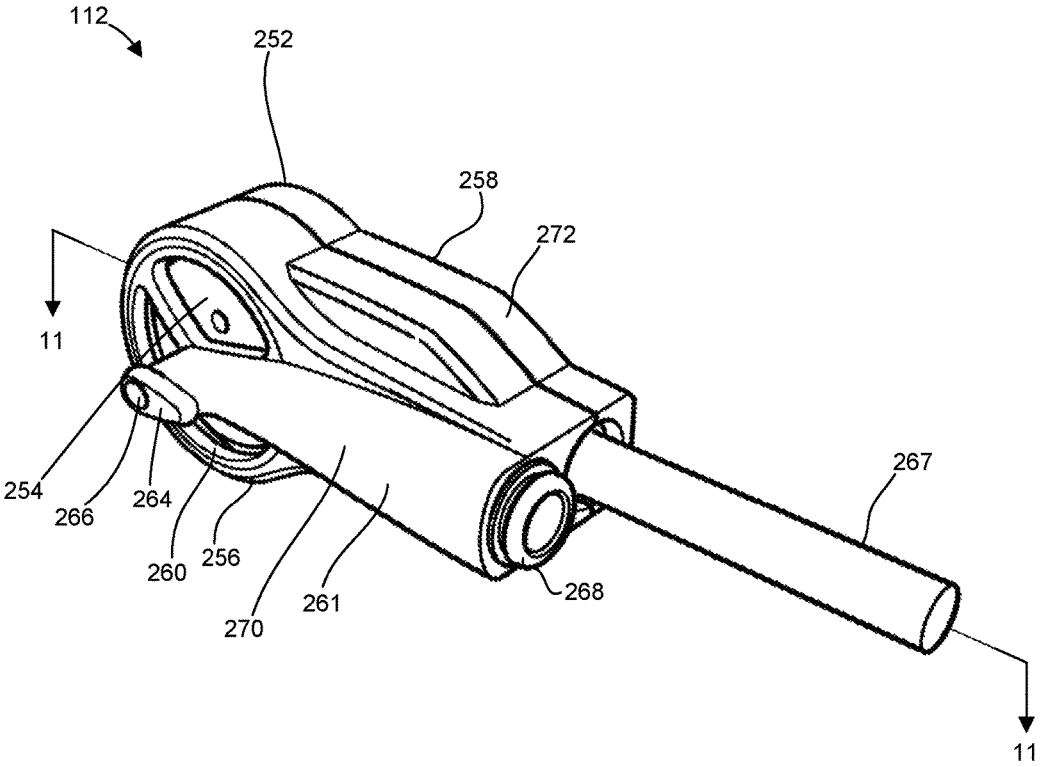
FIG. 9 is a perspective view of a mouthpiece assembly for use with a fluid delivery system of a hydration system.

FIG. 9 illustrates an example mouthpiece assembly 112. As illustrated in FIGS. 1 and 2, mouthpiece assembly 112 may be used in headgear assembly 102 of the hydration and air delivery system 100. In addition, however, mouthpiece assembly 112 may be used with other headsets that include a microphone disposed at the end of a support member, such as a microphone boom.

The mouthpiece assembly 112 is configured to permit audio communication from and the delivery of drinkable fluids to the user 126. To provide these functionalities, a microphone 254 is disposed at the end of a support member or microphone boom 267. A conduit 261 defining a fluid passageway 316 (as best seem in FIG. 11) is also supported by the support member 267. A mouthpiece 264 is provided at the distal end of the passageway 316 so as to be positioned in front of the microphone 254. The mouthpiece includes an outlet port 266 that is in fluid communication with the fluid conduit 261. A hose connector 268 may be provided at the proximal end of the fluid passageway 316 to connect to the fluid-delivery tube 111 shown in FIG. 2A.

Figure 10:
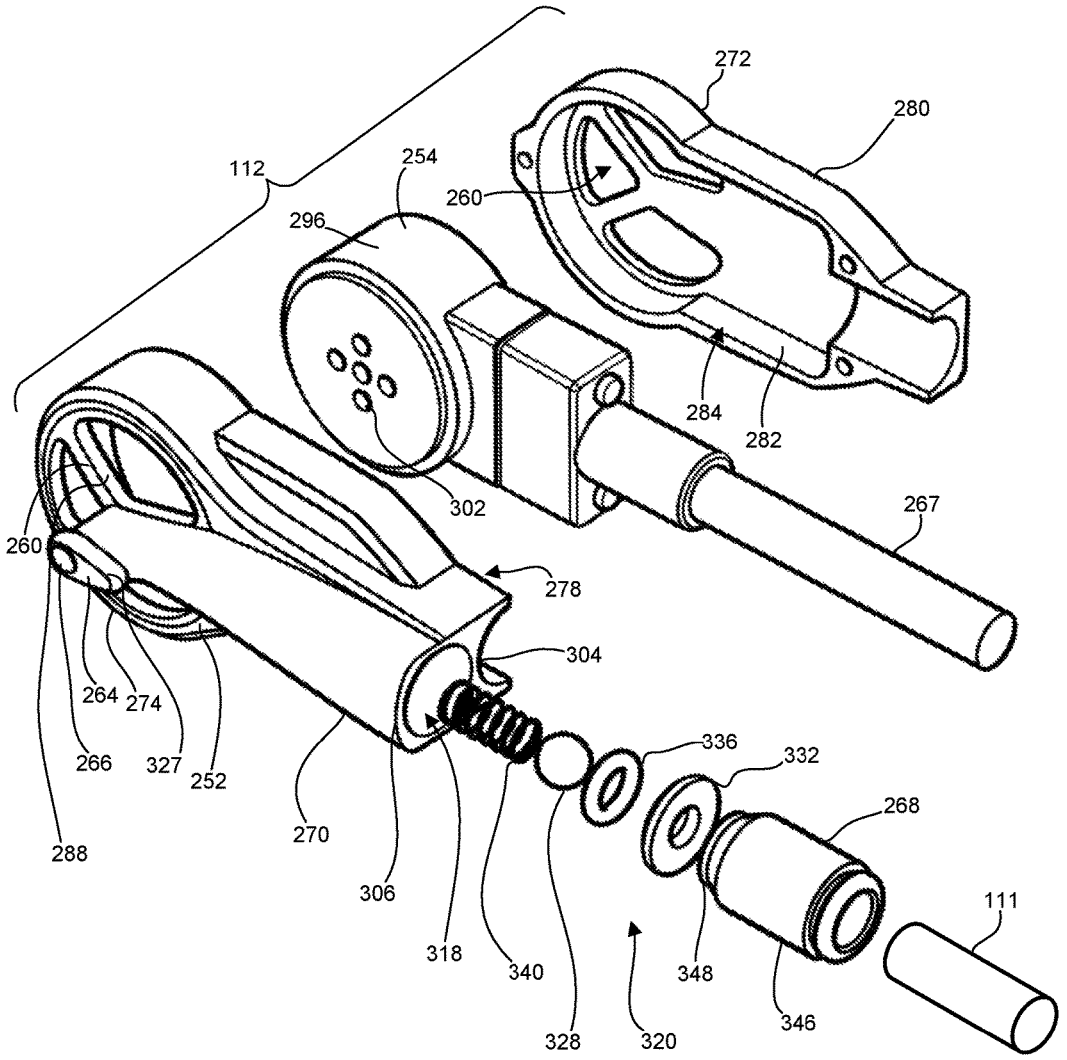
FIG. 10 is an exploded perspective view of the mouthpiece assembly of FIG. 9.

The mouthpiece assembly 112 may include a microphone case 252 that defines a microphone cavity for receiving microphone 254 therein. The microphone case 252 illustrated in FIG. 9 encases microphone 254. The case 252 of the present embodiment is formed from two halves: a front half 270 defining a front side 256 of the case that is intended to face the user 126 during use and a back half 272 defining a backside 258 of the case. The front half 270 defines a recessed area 278 and the back half 272 defines a recessed area 284 that cooperate with each other to form the microphone cavity when the halves are assembled to the microphone 254 as shown in FIG. 10. The front side 256 and backside 258 may include a plurality of openings 260 allowing sound to freely travel through the case 252 and into the microphone 254.

The microphone case 252 is supported on the support member 267. The fluid conduit 261 and the fluid supply passageway 316 it defines are in turn attached to the microphone case 252. The fluid conduit is configured to supply a drinkable fluid to the user 126. The conduit 261 may be integrally formed with the case 252, or may be a separate component attached to an outer surface of the case 252. In other approaches, however, the fluid conduit 261 and the passageway 316 it defines may be attached directly to the microphone 254 and/or support member 267.

The distal end of the fluid conduit 261 may include an integrally formed mouthpiece 264 or a separate mouthpiece.

The mouthpiece is preferably disposed on the front side 256 of case 252 at a distal end of the conduit 261 so that it is positioned adjacent to and in front of microphone 254. The mouthpiece includes an outlet 266 that is in fluid communication with passageway 316 so as to be able to supply fluid to a user's mouth. As best seen in FIG. 2, fluid is supplied to the mouthpiece assembly 112 by a tube 111 that is connected at is distal end to a hose connector 268 provided at the proximal end of conduit 261. The proximal end of tube 111 may be connected to a hydration reservoir (e.g., source 122) as described above via magnetic quick connect 106 and one or more other sections of tubing and/or fluid conduits making up hydration input conduit 110.

The mouthpiece assembly 112 is disposed on a distal end of a support member 267 (also known as a microphone boom). A proximal end of the support member 267 is preferably connected to or configured to connect to headgear such as a helmet or head bracket. Support member 267 is preferably flexible in order to permit user 216 to adjust the position of the mouthpiece assembly so that it is disposed in front of his or her mouth when wearing headgear to which it is attached. Flexible support member 267 will be described in more detail below.

Figure 11:
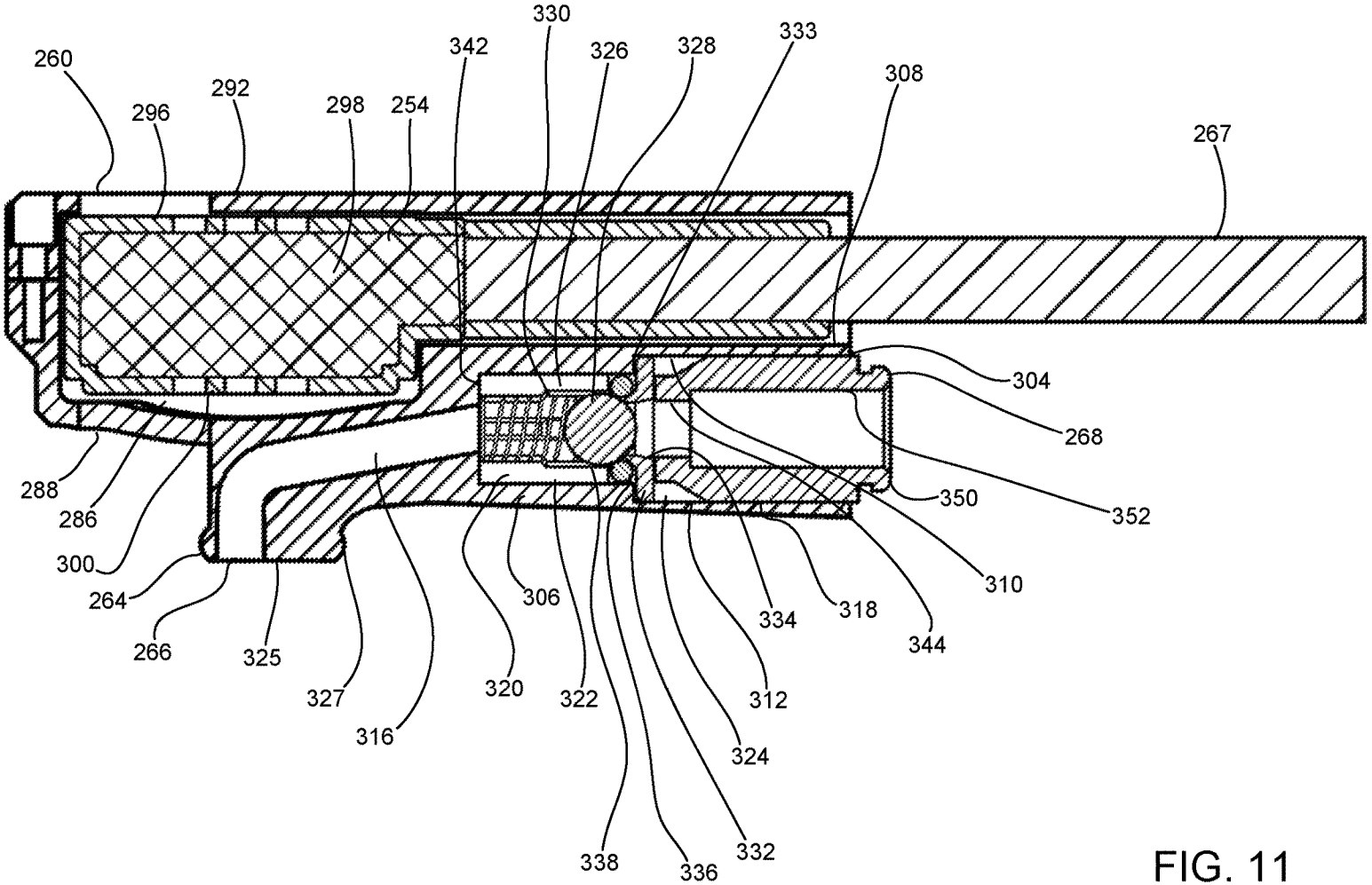
FIG. 11 is a cross-sectional top view of the mouthpiece assembly of FIG. 9 taken along cutline 11-11.

Referring to FIGS. 10 and 11, the front half 270 and a back half 272 of case 252 may sandwich the microphone 254 when assembled together. The halves may be secured together by fasteners, adhesive, clips, or other means known in the art. In other embodiments, the case 252 may be formed by more than two components that are assembled together. For example, the mouthpiece assembly 112 may include three or more components that are assembled together to form the case 252 and/or conduit 261.

The front half 270 may include a front face 274 and one or more sidewalls 276 extending substantially perpendicular from the front face to define the recessed area 278. The back half 272 may include a back face 280 and one or more sidewalls 282 extending substantially perpendicular from the back face to define the recessed area 284. The front face 274 may include a generally planar portion 288 that defines one or more openings 260 to permit sound to travel through the case 252 and into the microphone 254. Similarly, the back face 280 may include a generally planar portion 292 that defines one or more openings 260. The planar portions 288 and 292 may be shaped to match the shape of the microphone 254. The microphone 254 may include a housing 296 that houses the microphone electronics 298. The housing 296 may include opposing faces 300, which may be planar. One or both of the faces 300 may define one or more sound receiving holes 302 allowing soundwaves to reach the electronics 298 with less obstruction. In the illustrated embodiment, the faces 300 are circular. The planar portions 288, 292 of the case 252 may also be circular to match the shape of the microphone housing 296. Of course, the microphone 254 and case 252 may be other shapes in different embodiments.

The front half 270 may include an internal wall 304 and an external wall 306 that are spaced apart from each other. The distance between the internal wall 304 and the external wall 306 may vary along a length of the first half 270. A first surface 308 of the internal wall 304 cooperates with the sidewalls 276 to define the front receiving area 278. A second surface 310 of the internal wall 304 cooperates with the interior surface 312 of the external wall 306 to at least partially define the fluid passageway 316.

In one or more embodiments, each of the housing halves 270, 272 may be formed as a single-piece assembly with many of the above described features being integrally formed. The halves may be formed of metal, plastic, or a composite. They may also be machined, cast, injection molded, or 3-D printed. The manufacturing technique employed may dictate, however, the number of parts required to form the front half 270 and back half 272.

The fluid conduit 261 defines the fluid supply passageway 316 of the case 252 that conveys fluid from the tube 111 to the outlet 266 of mouthpiece 264. In one or more embodiments, the fluid passageway 316 includes a valve chamber 318. A valve 320 is disposed in the valve chamber 318. The valve 320 may be a check valve that permits fluid above a predetermined cracking pressure to flow to the outlet 266 of mouthpiece 264. On the other hand, when the pressure in tube 111 drops below the cracking pressure of the valve 320, fluid is prevented from flowing from the mouthpiece back towards the source 122 through tube 111. In addition, because air is prevented from entering tube 111 by valve 320, the hydration fluid pumped from source 122 and filling tube 111 will remain in tube 111 even when the pump is not energized, thus limiting the time to deliver fluid to outlet 266 the next time the pump in source 122 is energized. Further, because valve 320 is located proximate mouthpiece 264 it also helps limit the amount of hydration liquid that may flow out of the outlet 266 when the fluid pressure is below the threshold cracking pressure in tube 111.

The valve 320 includes a closing member biased, by a biasing member, to seat against a sealing surface so that fluid is inhibited from flowing to the mouthpiece when fluid pressure is below the threshold. The biasing force of the biasing member is sized or chosen so that the closing member disengages with the sealing surface in response to the pump of source 122 being energized. However, valve 320 is not limited to a valve having this structure and any check-valve, one-way valve or two-way valve exhibiting the cracking pressure characteristics described above may also be used.

The valve 320 may be a ball-type check valve. The valve chamber 318 may generally include a first portion 322 and a second portion 324 having a diameter larger than the first portion. The first portion 322 may include a ball guide having a plurality of projections 326. A check ball 328 of the valve 320 rides on the projections 326. Each of the projections may define a stopper 330 that prevents the check ball 328 from moving too far in the downstream direction. Excessive upstream movement of the check ball 328 is prevented by an annular plate 332. The annular plate 332 is disposed in the second portion 324 and is seated against a first shoulder 333. The annular plate 332 defines an inner bore that permits fluid to pass therethrough. The inner bore defines an inlet 334 of the valve 320. A sealing member 336, such as an O-ring or a gasket, is disposed between the check ball 328 and the annular plate 332. The sealing member 336 is seated against the tips 338 of the projections 326. A biasing member 340, such as a coil spring, urges the check ball 328 against the sealing member 336 to close the inlet 334. The biasing member 340 may be seated against a second shoulder 342. The biasing member is configured to firmly seat the ball 328 against the O-ring 336 when fluid pressure is below the threshold cracking pressure, and to allow the ball 328 to displace in the downstream direction allowing fluid to through the mouthpiece 264 when the fluid pressure is above the threshold.

Hose connector 268 connects the fluid supply passageway 316 of mouthpiece assembly 112 to the tube 111. The connector may be a female fitting or a male fitting. In the illustrated embodiment, the connector is a female fitting. The female fitting 268 may be received within the passageway 316 with an outside surface 346 engaging the walls of the passageway 316 and with a front end 348 disposed against the annular plate 332. The front end 348 includes a bore defining an inlet 344 to passageway 316. The rear end 350 of the fitting 268 may extend out of the passageway 316. The fitting 268 may be a quick-connect fitting (also known as a push-to-connect fitting) having an inside surface 352 that defines a bore for receiving the tube 111 therein. The fitting 268 includes features disposed within the bore that grip the tube 111 preventing the tube from being inadvertently removed from the fitting. The fitting 268 may include a release collar allowing the tube 111 to be removed from the fitting 268.

In the present embodiment, the front half 270 defines the fluid passageway 316 that extends from the outlet 266 of mouthpiece 264 to the inlet 344 defined in front end 348 and includes the valve chamber 318 disposed therein. The mouthpiece 264 extends generally away from the planar portion 288 and is located adjacent to the microphone 254. In one or more embodiments, the mouthpiece 264 is disposed within a perimeter of the front face 300. The mouthpiece 264 may include a raised ring 327 disposed around the tip 325. The raised ring 327 is ergonomically shaped to engage with a user's lips.

In one or more embodiments, the case 252 may only include one of the halves, which is attached to either the front side, the back side, or other portion of the microphone housing 296. For example, mouthpiece assembly 112 could only include the front half 270. The front half 270 may be connected to the microphone housing 296 by clips, fasteners, tape, or adhesives. The clips may be integrally formed features of the front half, the housing 296, or both.

The microphone 254 is disposed at the end of the flexible support member 267 and sometimes the two are provided as a unit together. An end portion of the flexible support member is disposed within the housing 296 of microphone 254. The housing 296 may define an opening for receiving the support member 267. The electrical wires of the microphone 254 may extend through the support member 267 and the housing 296 to connect to the microphone electronics 298. The support member 267 may include a sleeving that surrounds the microphone wires, such as a heat shrink tubing. The support member 267 may also include one or more stiffing elements internal to the sleeving or external to the sleeving. The stiffing element should be sufficiently stiff to hold the mouthpiece in place once positioned, yet sufficiently flexible to allow the position of the mouthpiece to be modified relative to the headgear so that a user can place the mouthpiece assembly 112 in a desired location. The stiffening element may also work in combination with the sleeving to provide this functionality. The stiffing element may allow the support member 267 to be bent, curved, or otherwise positioned between at least a first position and a second position, and is operable to hold the support member in the position. The stiffing element may comprise spiral wrap tubing formed of metal, plastic, or other material. The spiral wrap tubing may be disposed outside the sleeving, inside the sleeving, or may form the sleeving.

Figure 12:
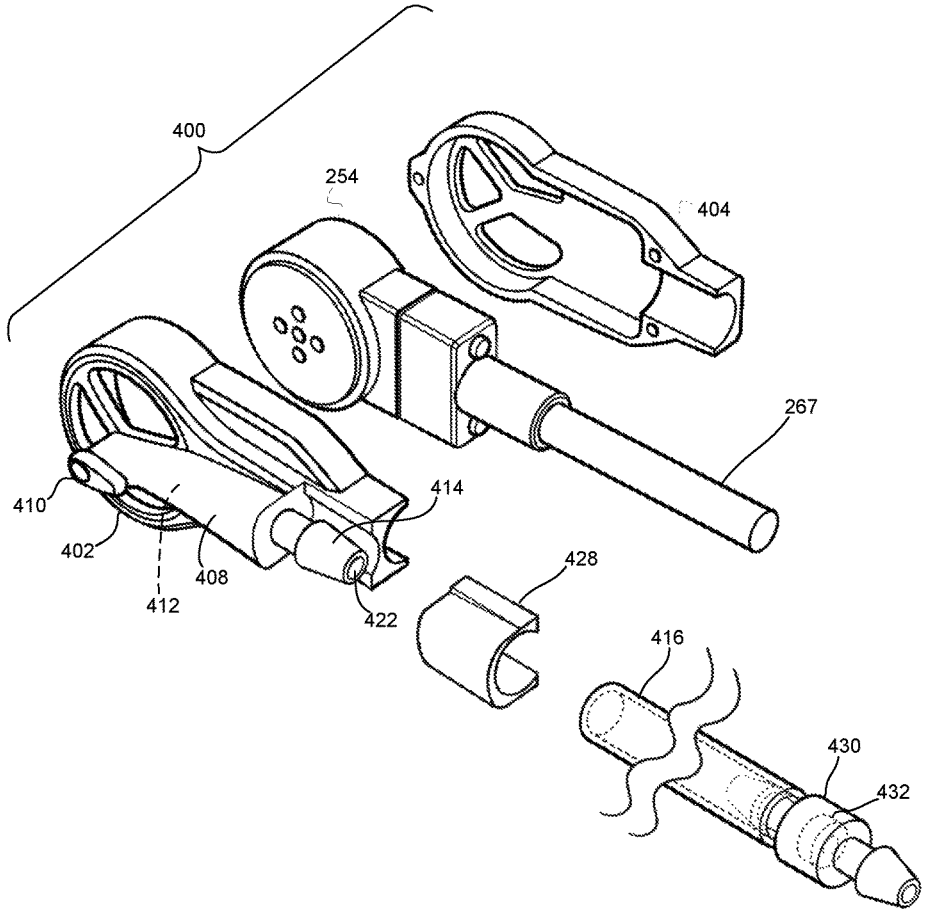
FIG. 12 is an exploded perspective view of another mouthpiece assembly for use with a fluid delivery system of a hydration system.

FIG. 12 illustrates a mouthpiece assembly 400 according to an alternative embodiment. Many features of the mouthpiece assembly 400 are similar to the mouthpiece assembly 112 and may not be described again here. Similar to the above embodiments, a front cover 402 may cooperate with a back cover 404 to encase a microphone 254 within a microphone receiving area. Alternatively, the back cover may be omitted and only the front connects to the microphone 254. The front cover 402 supports a fluid supply conduit 408. The fluid supply conduit 408 may be integrally formed with the front cover 402, or may be a separate component attached to an outer surface of the front cover or directly to the microphone 254. The fluid supply conduit 408 includes a mouthpiece 410 disposed at its distal end of the fluid supply conduit 408. Preferably the mouthpiece 410 extends from an outer surface of the front cover 402 proximate to the microphone 406. Fluid is supplied to an outlet of the mouthpiece 410 by a passageway 412 defined within the fluid supply conduit 408 and that has an inlet 422. The passageway 412 may thus be defined within the front cover 402 similar to passageway 316 of mouthpiece assembly 112. A connector 414 may be provided at the proximal end of the fluid passageway 412 to connect the fluid supply conduit 408 to a fluid-delivery tube, such as fluid delivery tube 416 or fluid delivery tube 111 of fluid delivery system 101. The connector 414 may be an integrally formed feature of the front cover 402, or maybe a separate component that attaches to the front cover. For example, the connector 414 may include threads that screw into a tapped hole of the cover 402.

In the illustrated embodiment, the connector 414 is a male connector receivable within the inside diameter of the tube 416. Preferably connector 414 is a barbed hose connector, but any suitable connector may be used. A clip 428 may be inserted over the tube to further secure the tube 416 to the connector 414 or for simply aesthetics reasons. The clip 428 may be a C-clip formed of a resilient material, e.g., spring steel or plastic that compresses the tube onto the connector 414.

Mouthpiece assemblies 112 and 400 are not limited to the illustrated connectors. Many different types of fluid connectors are known in the art and may be used to connect the fluid supply passageways provided in the mouthpiece assemblies in fluid communication with a fluid-supply tube.

A valve 430 may be provided to prevent fluid from leaking from the mouthpiece 410. Valve 430 should be disposed at a location as close as possible to mouthpiece assembly 400 to minimize the amount of water that may drip from the outlet of mouthpiece 410. The valve 430 may be disposed within the fluid passageway 412 of mouthpiece assembly 400 or may be interposed in the fluid delivery path external to the mouthpiece assembly. In the illustrated embodiment, the valve 430 is external to the mouthpiece assembly 400 and is provided at a proximal end of the tube 416. The other end of valve 430 may, for example, connect to fluid delivery tube 111 of fluid delivery system 101. The valve 430 may include a displaceable valve-closing member 432 biased to seat against a sealing surface. The valve 430 may be a check valve such as a ball check valve similar to ball check valve 320 or may be any other type of check valve, a one-way valve, or two-way valve that provides a threshold cracking pressure suitable for the fluid delivery system of the hydration subsystem.

Figure 16:
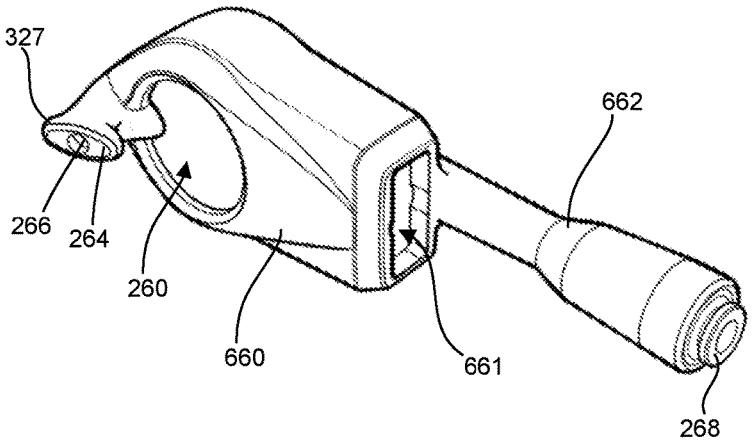
FIG. 16 is a front perspective view of a microphone case for use with a fluid delivery system of a hydration system
Figure 17:
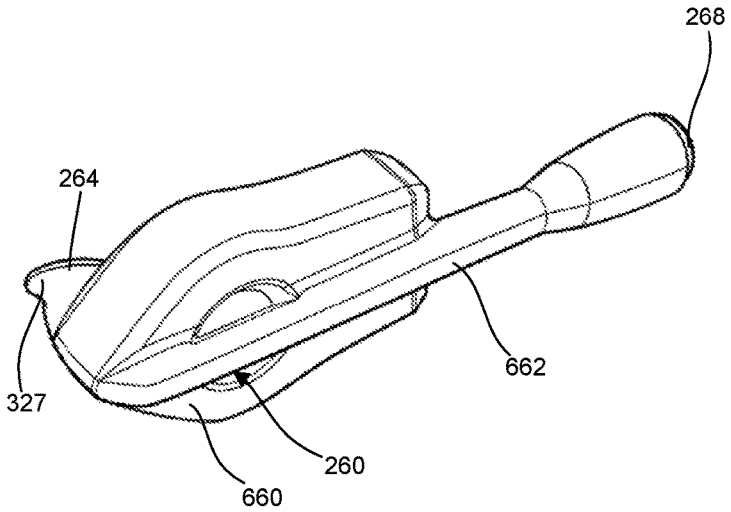
FIG. 17 is a rear perspective view of a microphone case for use with a fluid delivery system of a hydration system.
Figure 18:
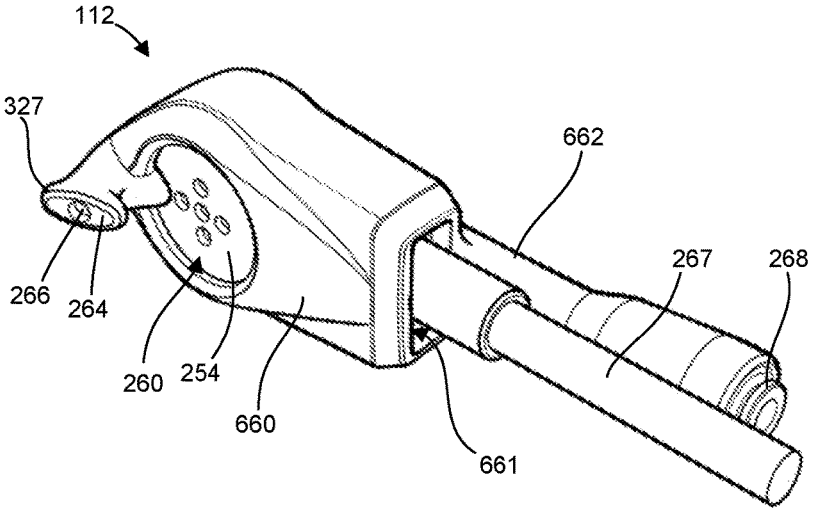
FIG. 18 is a perspective view of another embodiment of a mouthpiece assembly for use with a fluid delivery system of a hydration system.

Referring to FIGS. 16-18, another embodiment of a microphone case 660 that may be used in the microphone assembly 112 of the present patent document is described. Unlick microphone case 252 of the embodiment shown in FIG. 9, microphone case 660 is made from a flexible material, such as silicon rubber. As a result, the microphone case, 660 may be molded out of a single piece rather than multiple pieces. The microphone case, includes a microphone receiving area 661, which is sized to receive a microphone. Preferably the receiving area 661 is sized slightly smaller than the microphone 254. In this way, the opening of the receiving area 661 has to be elastically expanded to receive microphone 254 and one microphone 254 is properly located in receiving area 261, and the body of the microphone case 660 is no longer expanded, the case should fit snuggly on the microphone so it won't fall off during use.

The microphone case 252 shown in FIGS. 9 and 10 had a fluid conduit 261 disposed on the front side of the microphone case. The fluid conduit 662, on the other hand is disposed on the back side of the microphone case 660. Further, the hose connector 268 is located in a "pigtail" portion that extends from the main body portion of the microphone case.

As a result of this construction, the dimensions of the microphone case 660 will not alter the width of the microphone 254 as much as the microphone case shown in FIGS. 9-12 does. This may be important in situations where there is not much room between the mouth of user 126 and the chin guard of a helmet, such as helmet 103.

Making the microphone case out of silicon rubber also provides added safety to user 126, since the hard microphone housing 296 of microphone 254 is no covered with a soft, gel like material.

Push-to-connect connector 268 may be in a plastic tubular conduit that is over molded with the silicon rubber to form case 660. The distal end of the plastic tubular conduit can also include a one-way valve 320 as previously described.

Figure 13A:
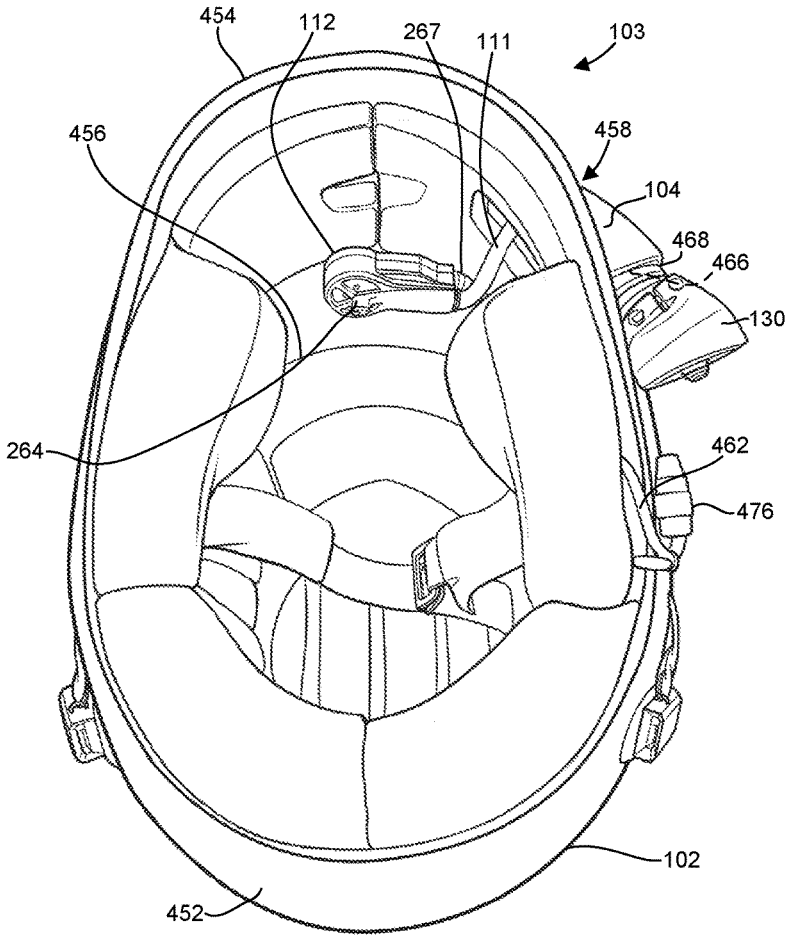
FIG. 13A is a bottom plan view of a headgear assembly including a helmet and a mouthpiece assembly.
Figure 13B:
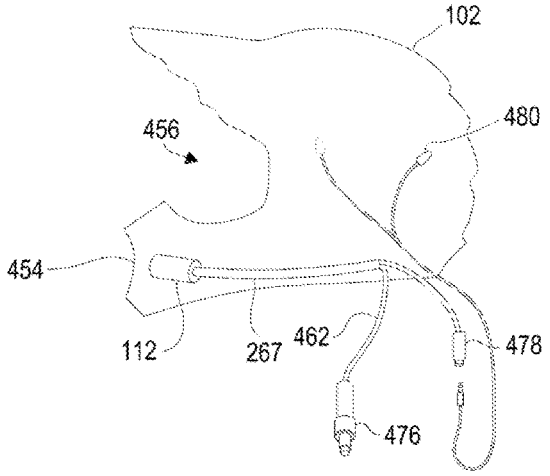
FIG. 13B is a schematic illustration of audio equipment of the headgear assembly of FIG. 13A.

Referring to FIGS. 13A and 13B, the combined fluid and audio delivery system may be integrated with headgear such as helmet 103 to form a headgear assembly 102. The helmet 103 may be a closed-face helmet having a shell 452 with a chin guard 454. The chin guard 454 cooperates with the main portion of the helmet to define an eye port 456. The helmet 1403 may include a see-through shield (not shown) pivotable to cover the eye port 456.

The helmet 103 may define a port 458 at interface 104 that provides fluid communication between the interior of helmet 103 and the primary fluid delivery tube 114 when the male coupling member 130 is coupled to the female coupling member 158 of magnetic quick connect 106 so as to form hydration and air delivery system 100. In this way, cooling and/or breathable air may be provided from source 120 to the interior of helmet 103 through port 458 by tube 114. The port 458 also allows input tube 111 of the hydration and air delivery system 100 to extend therethrough and connect to the connector 268 of mouthpiece assembly 112 at one end while also being connected to the inner communication path 140 of male coupling member 130 at inner member 148 at the other end. In this way, a hydration fluid, such as water, may be delivered from source 122 through tube 110*a*, splicer 108, tube 110*b*, the inner fluid communication paths 140, 168 of magnetic quick connect 106, tube 111, and fluid passageway 316 to outlet 266. Thus, as more fully explained below, user 216 may drink hydration fluids from outlet 266 of mouthpiece 264 when desired.

In some approaches, the port 458 may also permit the audio delivery system to be received within the interior of the helmet 103. In the illustrated embodiment, for example, an audio cord 462 enters the helmet under a bottom edge of the helmet 103, but in other embodiments, the audio cord 462 may enter the helmet through the port 458. The port 458 is provided in the chin guard 454 of helmet 103 in the embodiment shown in FIG. 13, but in the embodiment illustrated in FIG. 3B, port 458 would be located on the top of helmet 103. Other locations are also possible. The port 458 may be an opening defined through the shell and the padding at the desired location. A helmet interface 104 may be disposed on the helmet so as to be in fluid communication with the port 458 and cover the port 458.

In some embodiments, the interface 104 is a separate component connected to the helmet 103, such as at chin guard 454, by fasteners or clips to cover the port 458. In other embodiments, at least portions of the interface 104 are formed integral with the shell 452 of helmet 103.

FIG. 13B further illustrates one possible positioning of the mouthpiece assembly 112, support member 267, and the associated audio system within helmet 103. For sake of clarity other aspects of fluid delivery system 101 are omitted from FIG. 13B.

Referring to FIG. 13B, mouthpiece assembly 112 is supported on the distal end of support member 267 within the helmet 103 behind the chin guard 454 to position the mouthpiece assembly 112 in front of a user's mouth. The mouthpiece assembly 112 is arranged within the helmet 103 so that the outlet 266 of mouthpiece 264 is directed toward or faces the user as shown in FIG. 13A. The support member 267 is attached to an interior wall of shell 452 using adhesive or other suitable fasteners as is conventional in the art. Microphone cord 462 extends through the support member 267 to the microphone 254 in mouthpiece assembly 112. The support member 267 and microphone cord may be integrally formed or the support member may be wrapped around the microphone cord. As described above, the support member 267 is a stiff, yet flexible component that holds the mouthpiece assembly 112 in place while also allowing the mouthpiece assembly 112 to be repositioned to a position that is most comfortable for the user.

Once support member 267 is suitably connected to the interior wall of shell 452 an audio jack 476 may be provided on the helmet 103 to electrically connect the microphone to the audio system 124 via the cord 462. The audio jack 476 includes sufficient contacts to also allow earphones or ear buds having speakers 480 to be plugged into an earphone jack 478 that is electrically connected to audio jack 476. When audio jack 476 is mated with a connector of a second audio cord that is connected to audio system 124, which may, for example, comprise a transceiver or intercom, user 126 may communicate with and hear others (such as passengers and/or crew members) that are also connected to audio system 124. The speaker 480 may be connected to the helmet, or may be a personal speaker, e.g., head phone or ear bud, worn by the user.

It is to also be understood that any of the above described mouthpiece assemblies may be utilized in hydration systems with a wide variety of headgear that is suitable to support the mouthpiece assembly proximate to a user's mouth. The headgear may include, for example, any of a variety of conventional headsets that include a microphone boom extending from a head bracket. However, the support structure of the described mouthpiece assemblies may also be connected to or supported by a wide variety of other headgear. For example, in some embodiments, the headgear may comprise safety headgear, such as a helmet or hard hat. In other embodiments, the headgear may comprise other common headgear such as, for example, a hat, head bracket, or any other garment or device intended to be worn on a person's head. When the applicable headgear is safety headgear, the support structure may be configured to attach to the safety headgear, it may already be attached to the safety headgear, or at least a portion of the support structure may be formed integral with the safety headgear. Further, a headset of the present patent document may be attached to, or integrated with, any type of helmet, including, for example, motorcycle helmets (half, three quarter, open face, and full face), auto racing helmets, cycling helmets, snowboarding and skiing helmets, mountain climbing helmets, military and other tactical helmets, fire helmets, safety helmets, and rescue helmets. Furthermore, as will be appreciated from the disclosure below, the mouthpiece assemblies described herein may be used in hydration systems that do not also provide air to the user as does system 100.

Figure 14:
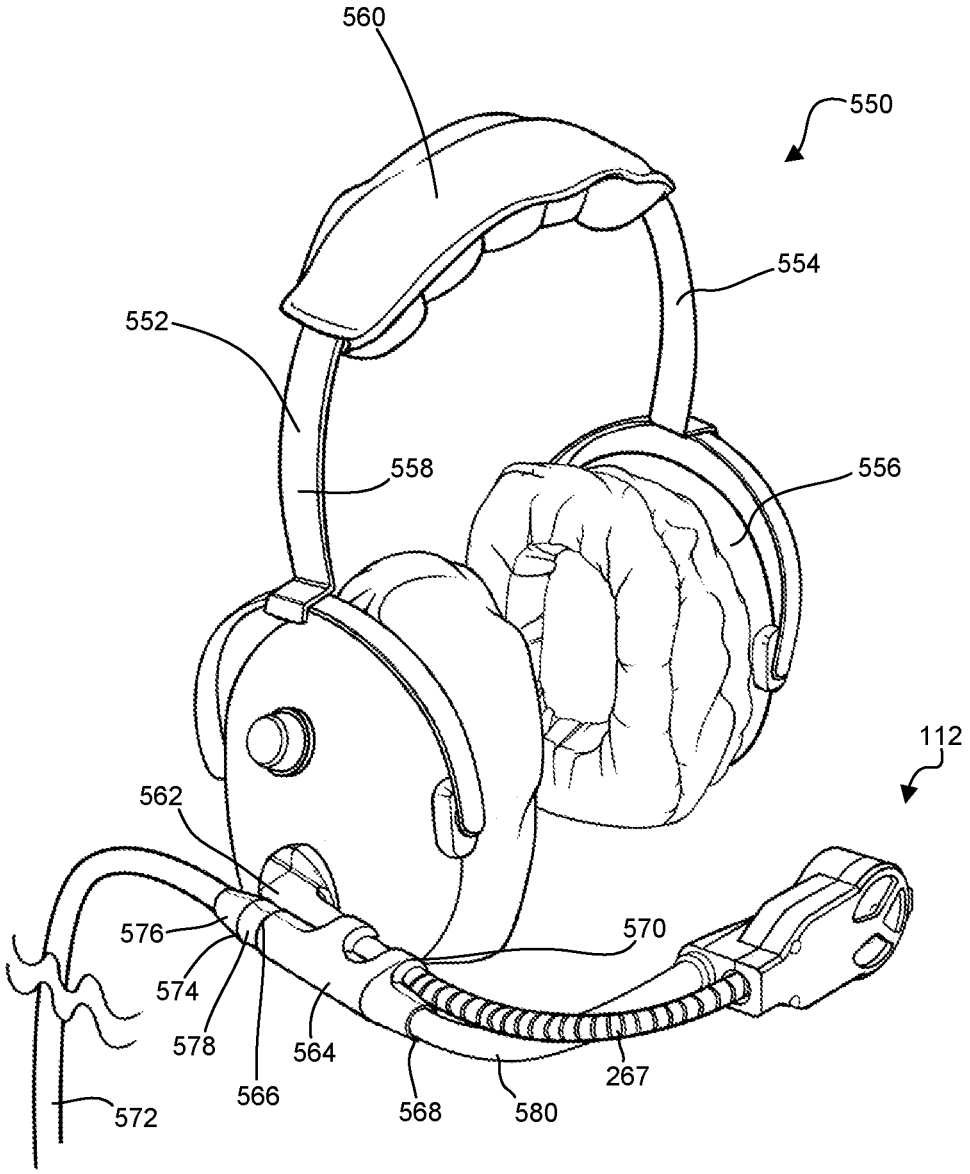
FIG. 14 illustrates a perspective view of another headgear assembly including a headset and a mouthpiece assembly.

Referring to FIG. 14, in one or more embodiments, the mouthpiece assembly 112 is utilized with a headgear 550 adapted to be worn on a user's head. The headgear 550 may include a headset 552 having a head mount bracket 554 and the head mount bracket may be configured to include two opposing support members 556 connected together by a resilient U-shaped spring member 558. The support members 556 may be adapted to cup a user's ears. When the two opposing support members are pulled away from one another, the U-shaped spring member produces a biasing force that tends to bias the opposing support members in a direction toward one another. Further, the head bracket mount is preferably configured so that when it is worn on a user's head the two opposing support members contact opposite sides of the user's head. In some embodiments, the head bracket mount is configured so that when it is worn on a user's head the two opposing support members contact opposite sides of the user's head and the U-shaped spring member wraps around the base of the user's skull. The headset may also further comprise a pad 560 disposed about at least a middle portion of the U-shaped spring member.

The boom 267 of the mouthpiece assembly 112 may be connected to one of the support members 556 by a connector 562 to attach the mouthpiece assembly 112 to the headset 552. The connector 562 may be pivotally attached to the support member 556. The connector 562 may include a tubular portion that receives a proximal portion of the boom 267 therein. The microphone wires may extend through the connector 562 and into at least one of the support members 556. Headset 552 may be wired or wireless. If wired, an audio cable with an audio plug (not shown) may extend from one of the support members 556 and be configured to connect with a conventional audio jack thereby enabling the headset 552 to be electrically connected to an audio system. One or more speakers may be provided in one or more of the support members 556.

The headset 552 is adapted for use with a hydration system including a fluid reservoir, such as source 122, via a main fluid-supply tube 572 that is in fluid communication with the fluid reservoir at a proximal end. The fluid-supply tube 572 may include multiple segments of tubing that are connected together by connectors, valves, or other hydraulic components. The headset 552 may include a support member 564 that connects the mouthpiece assembly 112 to the tube 572. In other embodiments, the tube 572 may directly connect with the connector 268 of the mouthpiece assembly 112.

The support member 564 may be supported on the connector 562 or support member 267 or both. In some embodiments, one or more portions of the support member 564 may be integrally formed with the support member 564. In other embodiments, the support member 564 and the connector 562 are separate components that are connected to each other. For example, the support member 564 may include a pair of clips 570 that define openings that receive the tubular body of the connector 562 and/or boom 267. The support member 564 has an upstream end 566 and a downstream end 568.

The upstream end 566 is connectable to the tube 572 by a conventional fitting such as a barbed hose connector or female push-to-connect connector, or by a magnetic quick connect 574 such as the magnetic quick connects described in U.S. Provisional Application 62/363,334, and U.S. application Ser. No. 15/652,847, which are incorporated by reference herein.

The magnetic quick connect 574 may, for example, include a male coupling member 576 and a female coupling member 578. It is expressly contemplated that the features described herein with respect to the male coupling member 576 and the female coupling member 578 may be incorporated in either of the male coupling member or the female coupling member. Further, the position of the male coupling member 576 and the female coupling member 578 may be reversed. Thus, for example, the coupling members of the magnetic quick connect 574 may be referred generically to as the downstream coupling member and upstream coupling member.

In the illustrated embodiment, the male member 576 is provided on the end of the tube 572 and the female member 578 is provided on the end 566 of the support member 564. In other embodiments, however, the female member 578 is provided on the tube 572 and the male member 576 is provided on the support member 564.

The male member 576 of the magnetic quick connect includes a fluid inlet port connectable to the tube 572 by a hose connector, such as a barbed hose connector or a female hose connector, formed in the male member 576. In one approach, the female member 578 includes a fluid outlet port that is in fluid communication with a fluid passageway extending through the support member 564. The downstream end of the support member 564 is connectable to a fluid delivery tube, such as tube 580 via a hose connector, such as a barbed hose connector or a female hose connector. The other end of the tube 580 is connected to the hose connector 268 of the mouthpiece assembly 112 as described above.

In the above described embodiment, support member 564 includes a fluid passageway for fluid to travel from the upstream end 566 to the downstream end 568. However, in other embodiments, the support member 564 may define a tubular cavity through which the tube 580 extends through to connect with the downstream end of female member 578. In such an embodiment, tube 580 extends through support member 564 so that its proximal end is connected to (and in fluid communication with) the female (or downstream) coupling member 578.

The male member 576 includes a fluid outlet port that connects with a fluid inlet port of the female member 578. For example, the male member 576 may have a projection that defines the fluid outlet port, and the female member 578 may have a receptacle that defines the fluid inlet port. The projection is received within the receptacle, for example as shown in FIG. 4C, and preferably with the taper angels previously described. Each of the coupling members 776 and 778 includes a magnet for selectively coupling the male member 576 to the female member 578 as described above.

Figure 15:
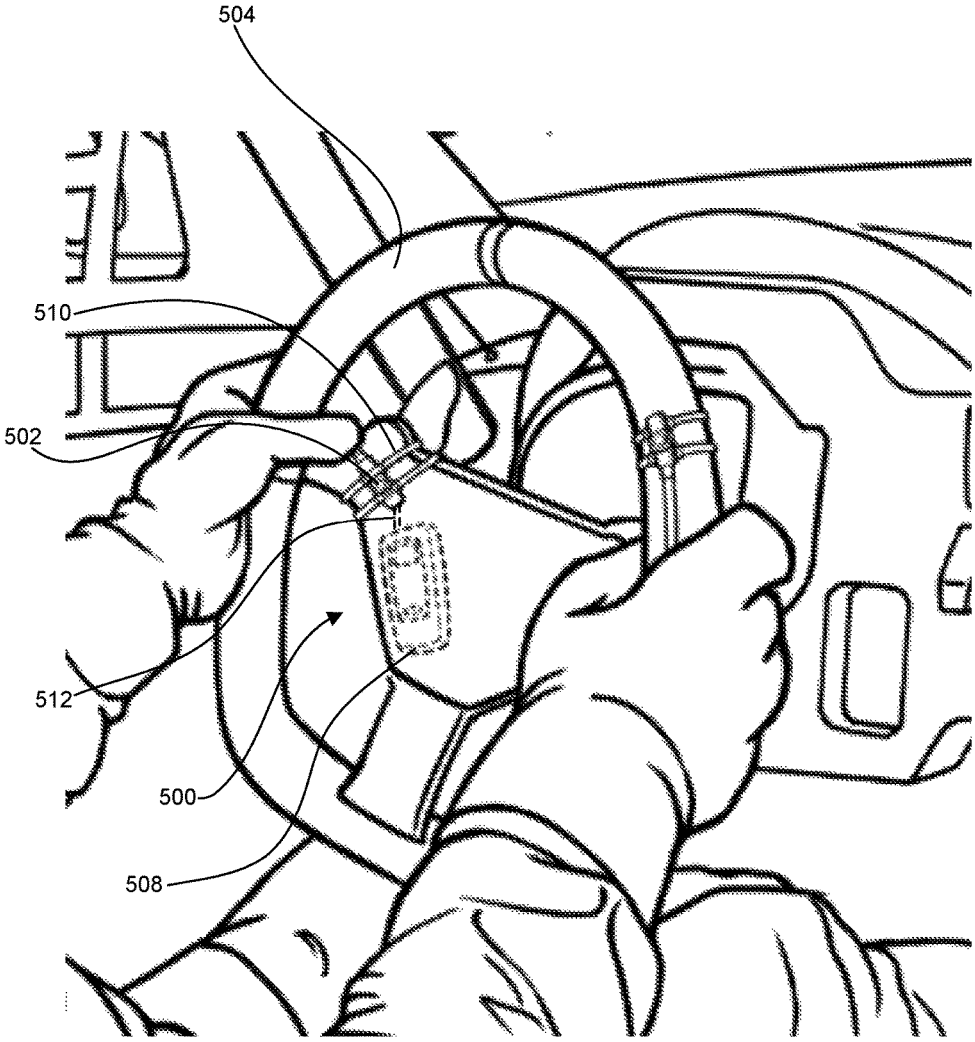
FIG. 15 illustrates an exemplary actuation system for use with a fluid delivery system.
Figure 15:
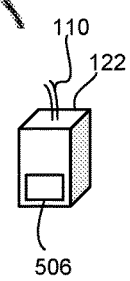

Referring now to FIG. 15, the fluid delivery system 101 further includes a wireless actuation system 500 for remotely controlling the actuation of the second fluid source 122. A switch 502, preferably a microswitch, is operably connected to the second fluid source 122 so that operation of the microswitch 502 controls the operation of the second fluid source 122. The microswitch 502 is mounted on the steering wheel 504 in a location sufficiently proximate to where a hand of user 126 would grip the steering wheel 504 to steer the vehicle 128. In this way, the user 126 can operate the microswitch 502 without the user 126 removing his or her hand from the steering wheel 504. In the embodiment illustrated in FIG. 15, the microswitch 502 is mounted sufficiently proximate the left-hand grip. In another embodiment, the microswitch 502 may be mounted sufficiently proximate the right-hand grip. In still another embodiment, a first microswitch 502 may be mounted sufficiently proximate the left-hand grip, and a second microswitch 502 may be mounted sufficiently proximate the right-hand grip. The microswitches 502 may be mounted at a peripheral bar portion of the steering wheel 504, or may be mounted at a hub of the steering wheel 504. Furthermore, the microswitches 502 may be mounted at a front portion, at a rear portion, and/or at a side portion of the steering wheel 504.

In a preferred approach, the microswitch 502 is operably connected to the second fluid source 122 via a wireless connection between a controller 506 and a wireless transmitter 508 that is removably mounted on the steering wheel 504 proximate the microswitch 502. In other approaches, however, the microswitch 502 may be operably connected to second fluid source 122 by being hard wired to the controller 506. The controller 506 is in turn operably connected to the second fluid source 122 so as to control the operation of the second fluid source 122.

The microswitch 502 may be mounted to the steering wheel 504 using a mounting means 510 provided proximate the microswitch 502. In the approach illustrated in FIG. 15, the mounting means 510 comprises a pair of cable ties and an elongated piece of heat shrink tubing 808. In other embodiments, the mounting means may comprise other suitable structures for mounting microswitch 502 in the desired location. The wireless transmitter 508 may similarly include a mounting means attached thereto for removably attaching the wireless transmitter 508 to the steering wheel 504.

As shown in FIG. 15, a cable 512 electrically couples the microswitch 502 to the transmitter 508 to form the wireless actuation system 500. Cable 512 in the illustrated embodiment is electrically connected to the microswitch 502 at one end and includes an electrical connector, such as a conventional tip sleeve mini jack or cable jack, at a second end for selectively electrically coupling the microswitch 502 to the transmitter 508 via a mating electrical connector (such as a mating socket connector) provided in one end of the transmitter 508. The mating electrical connector provided on one end of the wireless transmitter 508 removably receives the electrical connector.

The wireless transmitter 508 is preferably in the form of a FOB and may, for example, be a Bluetooth transmitter, and more preferably a Bluetooth Low Energy ("BLE") transmitter.

The microswitch 502 is preferably a normally open switch so that it is closed when the user 126 depresses the button of the microswitch 502 and is open when the user releases the button of the microswitch 502. In some approaches, the wireless transmitter 508 is configured to transmit a first signal when the microswitch 502 is closed. The first signal may, for example, instruct controller 506 to send power to the second fluid source 122 in order to pump fluids from the second fluid source 122 through the fluid delivery system 101 to the user 126. The wireless transmitter 508 may also be configured to transmit a second signal when the microswitch is open. The second signal may, for example, instruct the controller 506 to not send power to the second fluid source 122. When the controller 506 receives the second signal, it will stop sending power to second fluid source 122 if it was previously sending power to second fluid source 122, thereby stopping the pumping of fluids from the fluid delivery system 101 to the user 126. On the other hand, if the controller 506 had previously received the second signal, such that it had already stopped sending power to the second fluid source 122, then the controller 506 will simply continue to not send power to second fluid source 122. Then when the first signal is again transmitted to the controller 506 from the wireless transmitter 508, the controller 506 will again send power to the second fluid source 122 so that it again begins to pump fluids through the fluid delivery system 101 to the user 126. In this way, the user 126 can control the delivery of fluid from the second fluid source 122 on demand by simply pressing and releasing microswitch 502. Importantly, in the illustrated embodiment, the user 126 can press and release the microswitch 502 without ever having to remove his or her hand from the steering wheel 504, so that regardless of how fast the user 126 is traveling in the vehicle 128 or the difficulty of the terrain being traversed, the user 126 is able to instruct the fluid delivery system 101 to deliver the hydration fluid contained within the second fluid source 122 as desired while maintaining both hands on the steering wheel 504 and steering the vehicle 128.

While controller 506 may be configured to provide fluids as long as the user 126 is pressing the microswitch 502 as described above, controller 506 may also be configured to provide a defined aliquot of fluids each time the controller 506 receives the first command signal (e.g., when the user 126 presses the microswitch 502, regardless of how long the user holds down the microswitch). The aliquot, for example, may be a squirt of a certain duration or volume.

In view of the fact that user 126 can safely and conveniently operate microswitch 502 while driving the vehicle 128 under various conditions, it is much more likely that the user 126 will drink fluids from the second fluid source 122 more regularly, thereby allowing the user 126 to remain hydrated during his or her ride, race, etc.

The components defining the fluid delivery path of fluid delivery system 101 shown herein are exemplary in nature, and in other embodiments of fluid delivery system 101, additional components, fewer components, or completely different components may be used to form the fluid delivery path of fluid delivery system 101. In general terms, however, the fluid delivery system 101 will typically include a fluid delivery path having a proximal end adapted to be attached to first and second fluid sources 120, 122 so that fluid communication between the fluid delivery path and the first and second fluid sources 120, 122 may be established. In addition, each fluid delivery path will include an outlet port for delivering gas and liquid fluids to a user from the first and second fluid sources 120, 122, respectively. For example, liquid may be delivered through outlet port 266 in mouthpiece assembly 112 and gas may be delivered through port 458 in helmet 103. In preferred embodiments, a magnetic quick connect, such as magnetic quick connect 106, and a secondary fluid inlet, such as splicer 108, are interposed in the fluid delivery path of the fluid delivery system 101.

Figure 19:
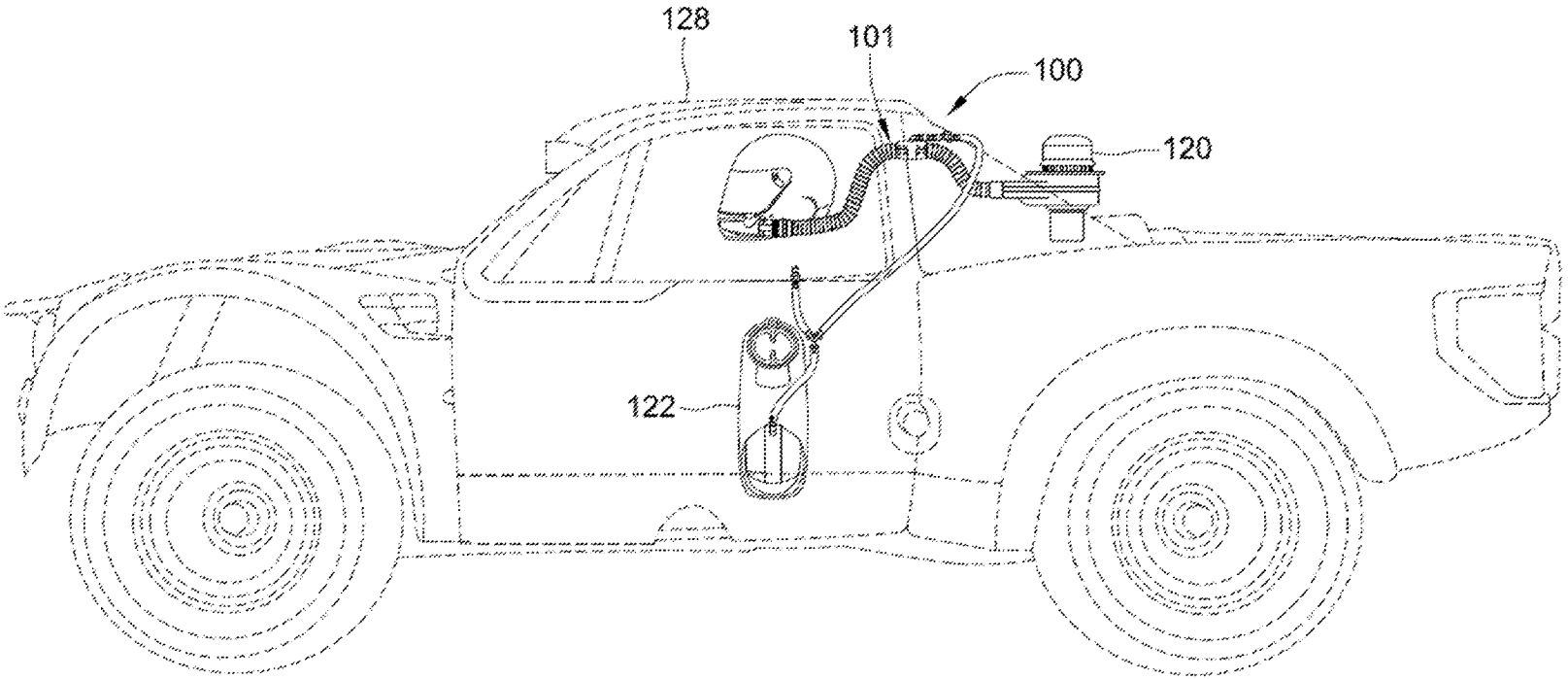
FIG. 19 illustrates an exemplary trophy truck with an alternative embodiment of a personal hydration and air cooling system that includes a two-channel fluid delivery system.
Figure 20:
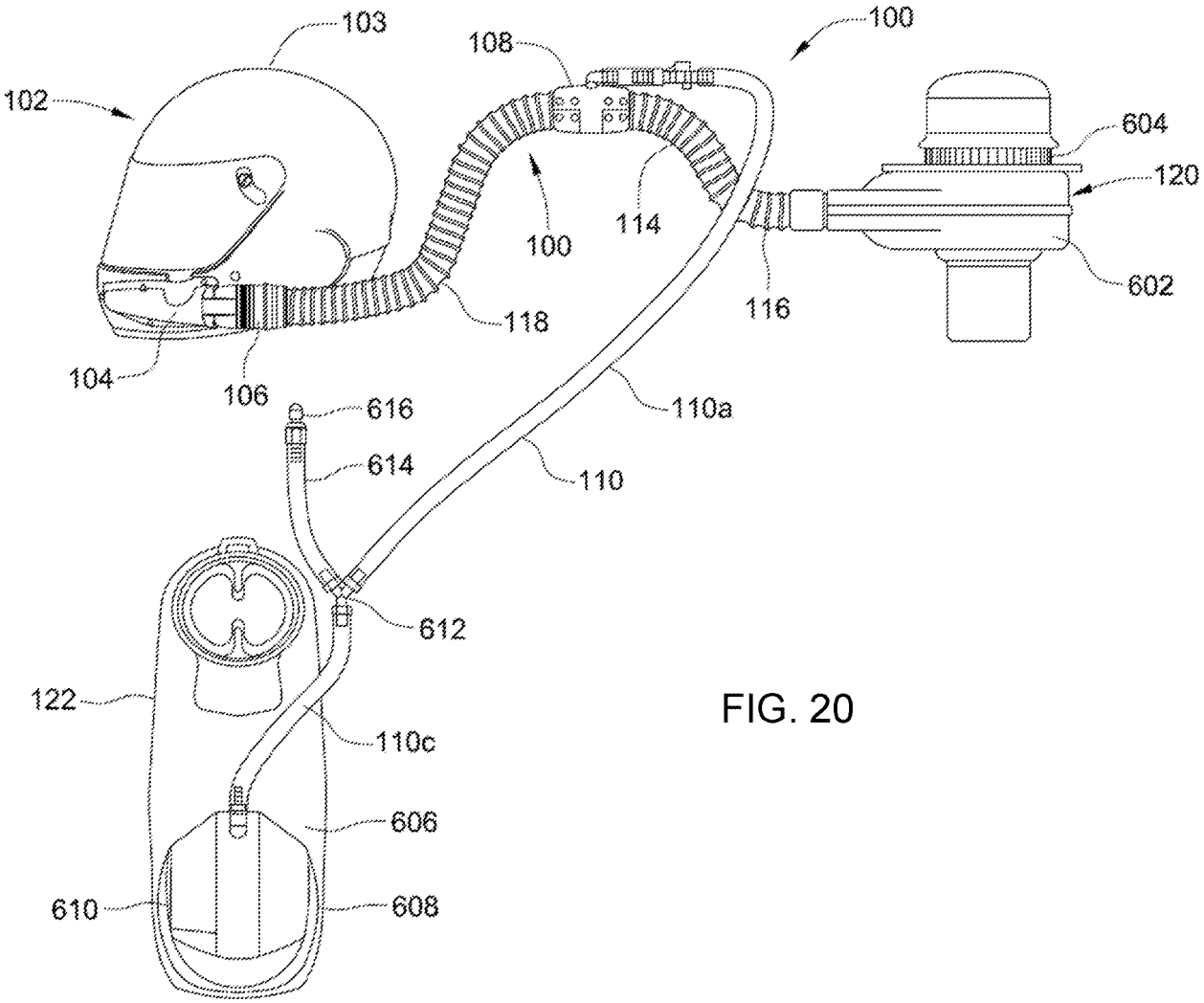
FIG. 20 is an enlarged view of the personal hydration and air cooling system of FIG. 16 with the trophy truck removed for better viewing.

Referring to FIG. 19, a vehicle 128 in the form of an exemplary trophy truck is shown. One potential layout of a personal hydration and air cooling system 100 that includes a two-channel fluid delivery system 101 for a vehicle 128 is also shown. An enlarged view of system 100 removed from the vehicle 128 is shown in FIG. 20. A similar layout may also be used for vehicles 128 other than the illustrated trophy truck. Further, the system may be replicated for a passenger.

Personal hydration and cooling system 100 of FIGS. 19 and 20 may include all of the features of the system 100 previously described above. System 100 of FIGS. 19 and 20, however, further illustrate exemplary first and second fluid sources 120, 122 that may be used in the gas and liquid subsystems, respectively, of system 100. In addition, the tubing 110 from source 122 to splicer 108 has a slightly different arrangement, because second fluid source 122 of system 100 may be refilled without having to remove source 122 from the vehicle 128.

First fluid source 120 in the present embodiment takes the form of an enclosed fan or blower 602 having a filter element 604 interposed between ambient air and the intake of the blower 602. The filter 604 removes dust and other debris delivered to user 126, thereby ensuring user 126 has a source of clean air to breathe. Fan 602 may, for example, me a Parker Pumper Fresh Air Blower, which can be obtained from RaceReady Products. Many other suitable fresh air blowers are also readily available on the market.

Second fluid source 122 may comprise a fluid reservoir 606 containing a potable liquid, such as water or a sports drink with electrolytes. Flexible reservoirs such as those provided by CAMELBAK™ are particularly well suited for use as fluid reservoir 606 of the hydration and cooling system 100 of the present patent document. As seen in FIG. 19, such reservoirs will fit well in many locations within the cabin of a vehicle 128, such as the illustrated trophy truck.

Although flexible hydration reservoirs, such as those provided by CAMELBAK™, are particularly well suited for use as fluid reservoir 606 in the system 100 of the present patent document, any suitable sealable container can be used for fluid reservoir 606. For example, depending on the application reservoir 606 may be made from rigid, semi-rigid, or flexible material. Furthermore, in some applications, it may be desirable to use a reservoir that is insulated, such as an insulated bottle or jug, for the reservoir 606. Alternatively, the reservoir 606 may be included within an insulated sleeve in some embodiments.

Regardless of the particular form of reservoir 606, the material or materials used in its construction (particularly any that will come in contact with the fluids contained within reservoir 606) should be suitable for contact with liquids that are intended for human consumption. This is also true with the other portions of liquid subsystem of hydration and cooling system 100 that may come in contact with fluid that is transported from the reservoir 606 through the liquid channel of fluid delivery system 101 to the user 126.

In the present embodiment, second fluid source 122 also includes a fluid control unit 608. Fluid control unit 608 includes a pump (not shown) contained within housing 610. The pump is in fluid communication with reservoir 606 through an output port of the reservoir. The pump is also in fluid communication with a proximal end of hydration input tube 110 of fluid delivery system 101. Fluid control unit 608 also includes a controller 506 that is in wireless communication with wireless actuation system 500. Controller 506 is in turn electrically and operably connected to the pump and power source in fluid control unit 608 so as to provide the necessary power to drive the motor of the pump when instructed by the wireless actuation system 500. As a result, wireless actuation system 500 may be used to wirelessly control the operation of the pump in fluid control unit 608 via controller 506 in the manner previously described.

Fluid control unit 608 and wireless actuation system 5000 collectively form a wireless pump system. And, while a wireless actuation system 500 is preferably employed to control the operation of the pump in fluid control unit, in other embodiments a microswitch 502 that is electrically connected to the pump or controller 506 may be used. However, in addition to eliminating the need for at least two conductors to electrically connect the switch 502 to the pump or controller 506, the wireless actuation system 500 may provide a number of advantages over a switch 502 that is electrically connected to the pump or controller 506 in controller 608.

The fluid control 106 unit and wireless actuation systems 140 described in co-pending U.S. application Ser. No. 15/652,847, the description of which is hereby incorporated by reference as if fully set forth herein, may be used for control unit 608 and wireless actuation system 500 of the present patent document.

Fluid source 122 may be suspended directly from a frame or roll cage member within the cabin of vehicle 128, or, alternatively, it may be placed in a bag, which is then suspended from the frame or roll cage member.

The hydration input tube 110 of the present embodiment includes a tube section 110*c* which is connected at a proximal end to the output of the pump in fluid control unit 106 and at a distal end to one branch of a Y-connector 612. A second branch of Y-connector 612 is connected to the proximal end of tube section 110*a*. The third branch of the Y-connector 612 is connected to the proximal end of a refill tube 614. The distal end of tube 614 is connected to a hose connector 616 that one-way valve. The hose connector 616 may connect to the distal end of tube 616 using a hose connector, such as a barbed hose connector. The distal end of hose connector 616 preferably includes a male or female mechanical quick connect or a magnetic quick connect, such as those previously described herein.

With the above configuration, when a driver 126 comes in for a pit stop or driver change, the fluids in reservoir 606 may be replenished by connecting a hose of a refill reservoir having a complementary connector to the distal end of connector 616. Liquid from the refill reservoir may then be transferred to reservoir 606 by driving the pump in control unit 608 in reverse, or using a pump on the refill system, to pump liquid from the refill reservoir to reservoir 606 via connector 614, connector 612, tube section 110*c*, and control unit 608.

The pump in control unit 608 may be driven in reverse, for example, when a button on transmitter 508, or another transmitter that is connected to controller 506, is depressed. In one approach, the wireless transmitter 508 is configured to transmit a third signal when a button on the transmitter 508 is pushed. The third signal may instruct controller 506 to send power with reverse polarity to the pump in fluid control unit 608 in order to drive it in the reverse direction.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed:

1. A combined microphone and fluid-delivery apparatus, the apparatus comprising:

a microphone disposed at an end of a support member;

a fluid passageway supported by the support member;

a mouthpiece disposed at a distal end of the passageway so as to be positioned adjacent the microphone, the mouthpiece defining an outlet port that is in fluid communication with the fluid passageway.

2. The apparatus of claim 1, further comprising a microphone case defining a microphone receiving area, wherein the microphone is disposed within the microphone receiving area, the microphone case is supported by the support member, and the fluid passageway is attached to the microphone case.

3. The apparatus of claim 2, wherein the microphone includes a microphone housing having a panel with a perimeter and defining at least one sound-inlet hole, and wherein the fluid passageway is attached to the microphone case so that the mouthpiece extends from the fluid passageway in a direction away from the panel at a location within a perimeter of the panel.

4. The apparatus of claim 2, wherein the fluid passageway and the mouthpiece are integrally formed with the microphone casing.

5. The apparatus of claim 1, wherein the fluid passageway further includes an inlet port configured to connect with a water-supply tube.

6. The apparatus of claim 5, wherein the inlet port is defined by a connector that is integrally formed with the housing, wherein the connector is configured to connect with the water-supply tube.

7. The apparatus of claim 1 further comprising a valve disposed in the fluid passageway.

8. The apparatus of claim 7, wherein the valve includes an inlet and a closing member biased to seal the inlet.

9. The apparatus of claim 7, wherein the valve further includes an annular plate defining an inlet and a check ball biased against the annular plate.

10. The apparatus of claim 1 further comprising a tubular fitting partially disposed within the fluid passageway with an outer surface of the fitting engaging with a wall of the fluid passageway and with a portion of the fitting extending from an inlet side of the fluid passageway, wherein the fitting defines a bore configured to receive a water-supply tube.

11. The apparatus of claim 1, wherein the support member is adjustable between at least a first position and a second position.

12. The apparatus of claim 11, wherein the support member may be bent between multiple positions and will retain its position once bent.

13. The apparatus of claim 11, wherein the support member comprises a spiral wrap tube.

14. A headset comprising:

a headgear;

a flexible support member having a microphone disposed at one end of the support member and being supported by the headgear at the other end of the support member;

a microphone case supported by the flexible support member and including a microphone-receiving area in which the microphone is received;

a fluid passageway attached to the microphone case;

a mouthpiece disposed at the distal end of the fluid passageway and adjacent the microphone, wherein the mouthpiece includes an outlet port that is in fluid communication with the passageway and that is pointed in a direction away from the microphone.

15. The headset of claim 14, further comprising a valve within the passageway.

16. A headset comprising:

a microphone casing defining a microphone-receiving area and a fluid-delivery enclosure that are separated by an internal wall of the microphone casing, the fluid-delivery enclosure including an outlet on an exterior surface of the casing and an inlet;

a microphone disposed in the microphone-receiving area; and a valve interposed between the inlet and outlet.

17. The headset of claim 16, wherein the fluid-delivery enclosure further includes a valve chamber and a passageway connecting the valve chamber in fluid communication with the outlet.

18. The headset of claim 16, wherein the casing defines a mouthpiece at a location adjacent the microphone and having a tip that defines the outlet.

19. The headset of claim 18, wherein the casing defines a planar portion adjacent a sound-receiving portion of the microphone, and the mouthpiece extending outwardly from the planar portion.

20. The headset of claim 19, wherein the planar portion defines at least one opening to permit sound to travel to the microphone.

21. The headset of claim 16, wherein the casing further includes a front half and a back half that cooperate to define the microphone-receiving enclosure and sandwich the microphone when assembled together.

22. The headset of claim 21, wherein the front half defines the fluid-delivery enclosure.

23. The headset of claim 21, wherein the front half includes the internal wall and the internal wall includes a first surface that forms a portion of the microphone-receiving enclosure and a second surface that forms a portion of the fluid-delivery enclosure.

24. The headset of claim 16, wherein the valve further includes an annular plate defining an inlet, a sealing member disposed against the annular plate, and a check ball biased against the sealing member.

25. A helmet assembly comprising:

a helmet; and a mouthpiece assembly supported by the helmet such that the mouthpiece assembly is disposed in a face region of the helmet, the mouthpiece assembly including a microphone and a mouthpiece defining a passageway configured to supply fluid to a user.

26. The helmet assembly of claim 25, wherein the mouthpiece assembly further includes a casing, the microphone is disposed within the casing, and the mouthpiece extends from the casing towards a back of the helmet.

27. The helmet assembly of claim 26, wherein the mouthpiece and the casing are integrally formed.

28. The helmet assembly of claim 25 further comprising a flexible support member connected to the mouthpiece assembly at a distal end and connected to the helmet to support the mouthpiece in the face region.

29. The helmet assembly of claim 28 wherein, the flexible support member has at least one audio cord disposed therein, the least one audio cord being electrically connected to the microphone.

30. The helmet assembly of claim 28, wherein flexible support member further includes a stiffening element configured to support the mouthpiece in a relatively fixed position in the face region.

31. The helmet assembly of claim 25 further comprising a fluid-supply tube connected to the mouthpiece and configured to extend through an access port defined in a shell of the helmet.

32. The helmet assembly of claim 31 further comprising a valve disposed in the mouthpiece and interposed between the mouthpiece and the fluid-supply tube.

33. A microphone casing, the microphone casing comprising:

a case defining a microphone-receiving area a fluid conduit disposed on a surface of the case and separated by an internal wall of the case, the fluid conduit including a hose connector at a first end and an outlet port at a second end.

34. A microphone casing according to claim 33, wherein the fluid conduit traverses from a back side of the microphone casing to the front side of the microphone casing along one wall of the casing.

35. A microphone casing according to claim 33, wherein the outlet port is directed in a direction away from the microphone-receiving area.

* * * * *